US012146340B2

(12) United States Patent
Green

(10) Patent No.: US 12,146,340 B2
(45) Date of Patent: Nov. 19, 2024

(54) METHODS, SYSTEMS, APPARATUSES, AND DEVICES FOR FACILITATING CLEANING OF A POOL

(71) Applicant: John Michael Green, Kivides (CY)

(72) Inventor: John Michael Green, Kivides (CY)

( * ) Notice: Subject to any disclaimer, the term of this patent is extended or adjusted under 35 U.S.C. 154(b) by 111 days.

(21) Appl. No.: 17/885,583

(22) Filed: Aug. 11, 2022

(65) Prior Publication Data

US 2024/0052664 A1 Feb. 15, 2024

(51) Int. Cl.
*E04H 4/16* (2006.01)

(52) U.S. Cl.
CPC ..... *E04H 4/169* (2013.01)

(58) Field of Classification Search
CPC ..... E04H 4/169; E04H 4/16; A61H 33/6042
USPC ..... 4/490, 488, 492; 15/1.7
See application file for complete search history.

(56) References Cited

U.S. PATENT DOCUMENTS

| | | | | |
|---|---|---|---|---|
| 2,141,811 | A | 12/1938 | Everson | |
| 3,018,491 | A | 1/1962 | Read | |
| 3,265,079 | A | 8/1966 | Blumenfeld | |
| 3,471,884 | A | 10/1969 | Wright | |
| 3,521,304 | A | 7/1970 | Ghiz | |
| 3,605,735 | A | 9/1971 | Soden | |
| 4,114,206 | A * | 9/1978 | Franc | E04H 4/169 134/167 R |
| 4,212,088 | A | 7/1980 | Goettl et al. | |
| 4,503,573 | A | 3/1985 | Handzel | |
| 4,717,078 | A | 1/1988 | Arp | |
| 5,392,472 | A * | 2/1995 | Maxfield | E04H 4/1254 4/490 |
| 6,280,639 | B1 | 8/2001 | Ortiz | |
| 6,311,353 | B1 | 11/2001 | Phillipson | |
| 6,578,207 | B1 | 6/2003 | Fratilla | |
| 6,601,244 | B1 * | 8/2003 | Goettl | E04H 4/169 4/490 |
| 6,899,285 | B2 * | 5/2005 | Goettl | E04H 4/169 239/206 |
| 8,322,908 | B1 | 12/2012 | Hartmann | |
| 8,905,625 | B2 | 12/2014 | Hartmann et al. | |
| 9,421,581 | B2 | 8/2016 | Winkler | |
| 2007/0192970 | A1 | 8/2007 | Hui | |

(Continued)

FOREIGN PATENT DOCUMENTS

| | | | | |
|---|---|---|---|---|
| AU | 2016102102 A4 * | 2/2017 | | B05B 1/14 |
| WO | WO-2006013449 A1 * | 2/2006 | | E04H 4/1654 |
| WO | WO-2020095791 A1 * | 5/2020 | | A23K 10/20 |

*Primary Examiner* — Lori L Baker

(74) *Attorney, Agent, or Firm* — Dhiraj Jindal; PATENT YOGI LLC

(57) ABSTRACT

An apparatus for facilitating cleaning of a pool. Further, the apparatus comprises an angled nozzle disposed in the pool. Further, the angled nozzle comprises an inlet nozzle portion, an outlet nozzle portion, and a curved nozzle portion. Further, the inlet nozzle portion is to be attached to a return line of the pool and the curved nozzle portion extends between the inlet nozzle portion and the outlet nozzle portion. Further, a central axis of the outlet nozzle portion is offset at an angle relative to a central axis of the inlet nozzle portion. Further, the angle is an acute angle. Further, a first amount of water flows out of an outlet opening of the outlet nozzle portion with a flow characteristic based on the angle. Further, the flowing imparts a circular motion to a second amount of water present in the pool with a motion characteristic.

15 Claims, 18 Drawing Sheets

(56) References Cited

U.S. PATENT DOCUMENTS

| | | | | |
|---|---|---|---|---|
| 2011/0272500 | A1 | 11/2011 | Johnston | |
| 2012/0227175 | A1* | 9/2012 | Ford | E04H 4/1218 4/490 |
| 2020/0095791 | A1* | 3/2020 | Marano | E04H 4/169 |

* cited by examiner

METHODS, SYSTEMS, APPARATUSES, AND DEVICES FOR FACILITATING CLEANING OF A POOL

FIELD OF THE INVENTION

Generally, the present disclosure relates to the field of cleaning. More specifically, the present disclosure relates to methods, systems, apparatuses, and devices for facilitating cleaning of a pool.

BACKGROUND OF THE INVENTION

A swimming pool requires hand-netting for cleaning the pool of leaves and insects that have fallen in the pool. It appeared ridiculous in this modern age that the swimming pool did not self-clean. On other hand, some swimming pools have a full filtration system designed to clean the water in the swimming pools, but there is debris which is fallen in the swimming pools remains left on the surface of the water and does not enter the filtration system but is blown and moved around the surface as if it was flotsam or jetsam on an open sea. And the best way to keep the swimming pool clean was to place a cover over the whole swimming pool and only uncover it when the swimming pool is used. Return jets used in the swimming pools squirt the return water back into the swimming pool by restricting the outflow by using an eyeball fitting of a much smaller diameter than the pipework and the pump used in the consecutive dilution system.

The swimming pool normally has skimmers, suction lines, a circulation pump, a filter, and return lines. The skimmers are placed on the walls of the swimming pool. The water level in the pool is calculated so half the skimmer's mouth is covered. The skimmer is the entrance to the consecutive dilution system. The skimmer is fitted with a skimmer basket that sieves large pieces of debris that enters the skimmer's mouth. The debris is trapped in the basket to be removed once the swimming pool's pump is switched off. There are three of these sieves each getting consecutively smaller mesh sizes to sieve out the smaller items that enter the consecutive dilution system. The skimmer does not pull by suction more than eight inches, this is due to the pipe opening that goes to the pump being far smaller than the skimmer's mouth. The second sieve is located at the entrance to the circulation pump. Further, the pump is designed to slip. The pump is a vane style pump that will slip if any of the inlets or outlets of the swimming pool's circulation system as blocked. This is for safety requirements that require the pump to slip if anyone in the pool comes into contact with either the inlet skimmers or outlet return jets. Restricting the outlet of the return jets reduces the flow entering the skimmers as it causes the pump to slip. The water that exits the return jet is pushed to the surface, as this phenomenon falls under the Newtonian laws of motion as the water becomes an immovable object pinned in by the four walls and the bottom of the swimming pool. The return jet water hits the immovable object of the water and takes the path of least resistance which is the open surface. Further, the water that is pushed to the surface creates ripples similar to a stone being thrown into a pond. The ripples take anything floating on the surface to all corners of the pool and not into the skimmer. This describes how cleaned water immediately surfaces, and becomes the surface of the water and as it is the surface of the water that is skimmed off the deeper water does not get filtered and is called dead areas within the swimming pool. These dead areas cause the walls to become dirty as well as a tide mark around the surface of the water where it splashes against the walls. Whilst hand skimmer nets are the major seller when it comes to swimming pool maintenance wall cleaning brushes are second. Further, it is observed that as little as 10 percent of debris falling onto the swimming pool surface gets drawn into the consecutive dilution system due to the rippling effect and lack of direction of the water. This explains the massive sale of hand skimmer nets sold each year to clean dirty swimming pools of leaves and insects that enter the pool. The other result of this squirting is the stagnant or dead areas of the swimming pool. Also, the disinfectants which are used to treat the swimming pool chemistry are not mixed at all due to this squirting. Further, the deeper the water the lesser disinfection chemicals are found. This is especially true with the swimming pools fitted with a main drain at the bottom of the deep end. When the cover of the main drain is removed algae is almost always discovered inside and bore testimony that the disinfectant has not reached the deepest parts of the pool due to the dead areas. Further, the drain at the bottom of the swimming pool also connects to the circulation system. When these drains are uncovered they always show algae growing inside. Whilst the swimming pool floor will look clean as it is vacuumed every week or so to remove the algae spores inside the drain but due growth of the algae inside the drain shows that the disinfectant is not reaching the bottom of the pool.

Therefore, there is a need for improved methods, systems, apparatuses, and devices for facilitating cleaning of a pool that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is an apparatus for facilitating cleaning of a pool, in accordance with some embodiments. Further, the apparatus may include at least one angled nozzle disposed in the pool. Further, the at least one angled nozzle may be configured to be attached to at least one return line of a dilution system of the pool. Further, each of the at least one return line carries a first amount of water of the pool from the dilution system to each of the at least one angled nozzle for dispensing the first amount of water into the pool. Further, each of the at least one angled nozzle may include an inlet nozzle portion, an outlet nozzle portion, and a curved nozzle portion. Further, the inlet nozzle portion may be configured to be attached to an outlet portion of each of the at least one return line to align an inlet opening of the inlet nozzle portion with an opening of the outlet portion for fluidly coupling each of the at least one angled nozzle to each of the at least one return line. Further, the outlet nozzle portion may include an outlet opening. Further, the curved nozzle portion may be extending between the inlet nozzle portion and the outlet nozzle portion. Further, the inlet nozzle portion, the outlet nozzle portion, and the curved nozzle portion define an internal channel for fluidly coupling the inlet opening with the outlet opening. Further, a central axis of the outlet nozzle portion may be offset at an angle relative to a central axis of the inlet nozzle portion based on the curved nozzle portion. Further, the angle may be at least one acute angle. Further, the first amount of water flows out of the outlet opening in the pool with at least one flow characteristic based on the angle. Further, the flowing of the first amount of water in the pool imparts a circular motion to a second amount of water present in the pool with at least one motion characteristic based on the at least one flow characteristic of the first amount of water. Further, the imparting of the circular motion to the second amount of water present in the pool with the at least one motion characteristic facilitates the cleaning of the second amount of water present in the pool.

Further disclosed herein is an apparatus for facilitating cleaning of a pool, in accordance with some embodiments. Further, the apparatus may include at least one angled nozzle disposed in the pool. Further, the at least one angled nozzle may be configured to be attached to at least one return line of a dilution system of the pool. Further, each of the at least one return line carries a first amount of water of the pool from the dilution system to each of the at least one angled nozzle for dispensing the first amount of water into the pool. Further, each of the at least one angled nozzle may include an inlet nozzle portion, an outlet nozzle portion, and a curved nozzle portion. Further, the inlet nozzle portion may be configured to be attached to an outlet portion of each of the at least one return line to align an inlet opening of the inlet nozzle portion with an opening of the outlet portion for fluidly coupling each of the at least one angled nozzle to each of the at least one return line. Further, the outlet nozzle portion may include an outlet opening. Further, the curved nozzle portion may be extending between the inlet nozzle portion and the outlet nozzle portion. Further, the inlet nozzle portion, the outlet nozzle portion, and the curved nozzle portion define an internal channel for fluidly coupling the inlet opening with the outlet opening. Further, a central axis of the outlet nozzle portion may be offset at an angle relative to a central axis of the inlet nozzle portion based on the curved nozzle portion. Further, the angle may be at least one acute angle. Further, the first amount of water flows out of the outlet opening in the pool with at least one flow characteristic based on the angle. Further, the flowing of the first amount of water in the pool imparts a circular motion to a second amount of water present in the pool with at least one motion characteristic based on the at least one flow characteristic of the first amount of water. Further, the imparting of the circular motion to the second amount of water present in the pool with the at least one motion characteristic facilitates the cleaning of the second amount of water present in the pool. Further, the outlet nozzle portion may be fixedly coupled with the curved nozzle portion. Further, the curved nozzle portion may be rotatably coupled with the inlet nozzle portion using a ball joint mechanism. Further, the ball joint mechanism allows the curved nozzle portion to be rotated about the central axis of the inlet nozzle portion between a plurality of first positions. Further, the at least one flow characteristic of the first amount of water flowing out of the outlet opening in the pool may be based on each of the plurality of first positions.

Further disclosed herein is an apparatus for facilitating cleaning of a pool, in accordance with some embodiments. Further, the apparatus may include at least one angled nozzle disposed in the pool. Further, the at least one angled nozzle may be configured to be attached to at least one return line of a dilution system of the pool. Further, each of the at least one return line carries a first amount of water of the pool from the dilution system to each of the at least one angled nozzle for dispensing the first amount of water into the pool. Further, each of the at least one angled nozzle may include an inlet nozzle portion, an outlet nozzle portion, and a curved nozzle portion. Further, the inlet nozzle portion may be configured to be attached to an outlet portion of each of the at least one return line to align an inlet opening of the inlet nozzle portion with an opening of the outlet portion for fluidly coupling each of the at least one angled nozzle to each of the at least one return line. Further, the outlet nozzle portion may include an outlet opening. Further, the curved nozzle portion may be extending between the inlet nozzle portion and the outlet nozzle portion. Further, the inlet nozzle portion, the outlet nozzle portion, and the curved nozzle portion define an internal channel for fluidly coupling the inlet opening with the outlet opening. Further, a central axis of the outlet nozzle portion may be offset at an angle relative to a central axis of the inlet nozzle portion based on the curved nozzle portion. Further, the angle may be at least one acute angle. Further, the first amount of water flows out of the outlet opening in the pool with at least one flow characteristic based on the angle. Further, the flowing of the first amount of water in the pool imparts a circular motion to a second amount of water present in the pool with at least one motion characteristic based on the at least one flow characteristic of the first amount of water. Further, the imparting of the circular motion to the second amount of water present in the pool with the at least one motion characteristic facilitates the cleaning of the second amount of water present in the pool. Further, the outlet nozzle portion may be fixedly coupled with the curved nozzle portion. Further, the curved nozzle portion may be rotatably coupled with the inlet nozzle portion using a ball joint mechanism. Further, the ball joint mechanism allows the curved nozzle portion to be rotated about the central axis of the inlet nozzle portion between a plurality of first positions. Further, the at least one flow characteristic of the first amount of water flowing out of the outlet opening in the pool may be further based on each of the plurality of first positions. Further, the ball joint mechanism further allows the curved nozzle portion to be rotated about a first axis perpendicular to the central axis of the inlet nozzle portion between a plurality of second positions. Further, the angle corresponds to each of the plurality of second positions. Further, the ball joint mechanism further allows the curved nozzle portion to be rotated about a second axis perpendicular to the first axis and the central axis of the inlet nozzle portion between a plurality of third positions. Further, the at least one flow characteristic of the first amount of water flowing out of the outlet opening in the pool may be further based on each of the plurality of third positions.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
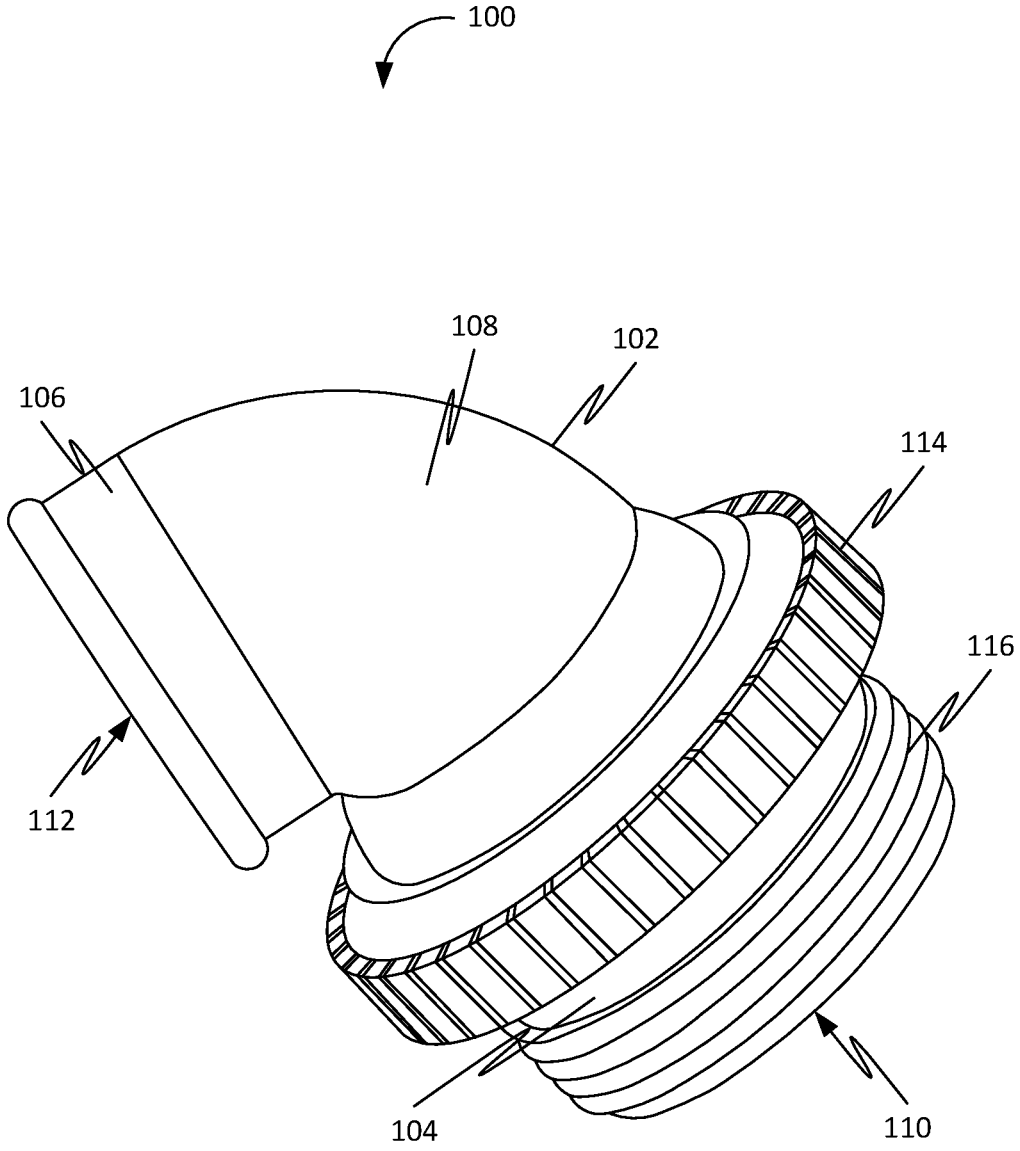
FIG. 1 is a right side perspective view of an apparatus for facilitating cleaning of a pool, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of methods, systems, apparatuses, and devices for facilitating cleaning of a pool, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor, and at least one actuator. Examples of the one or more client devices and/or the server computer may include, a desktop computer, a laptop computer, a tablet computer, a personal digital assistant, a portable electronic device, a wearable computer, a smartphone, an Internet of Things (IoT) device, a smart electrical appliance, a video game console, a rack server, a super-computer, a mainframe computer, mini-computer, micro-computer, a storage server, an application server (e.g. a mail server, a web server, a real-time communication server, an FTP server, a virtual server, a proxy server, a DNS server, etc.), a quantum computer, and so on. Further, one or more client devices and/or the server computer may be configured for executing a software application such as, for example, but not limited to, an operating system (e.g. Windows, Mac OS, Unix, Linux, Android, etc.) in order to provide a user interface (e.g. GUI, touch-screen based interface, voice based interface, gesture based interface, etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third party database, a public database, a private database, and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as but not limited to, data compression, data backup, data redundancy, deduplication, error correction, data fingerprinting, role based access control, and so on.

Further, one or more steps of the method disclosed herein may be initiated, maintained, controlled, and/or terminated based on a control input received from one or more devices operated by one or more users such as, for example, but not limited to, an end user, an admin, a service provider, a service consumer, an agent, a broker and a representative thereof. Further, the user as defined herein may refer to a human, an animal, or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human readable secret data (e.g. username, password, passphrase, PIN, secret question, secret answer, etc.) and/or possession of a machine readable secret data (e.g. encryption key, decryption key, bar codes, etc.) and/or or possession of one or more embodied characteristics unique to the user (e.g. biometric variables such as but not limited to, fingerprint, palm-print, voice characteristics, behavioral characteristics, facial features, iris pattern, heart rate variability, evoked potentials, brain waves, and so on) and/or possession of a unique device (e.g. a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g. transmitting and/or receiving) with one or more sensor devices and/or one or more actuators in order to perform authentication. For example, the one or more steps may include receiving, using the communication device, the secret human readable data from an input device such as, for example, a keyboard, a keypad, a touch-screen, a microphone, a camera, and so on. Likewise, the one or more steps may include receiving, using the communication device, the one or more embodied characteristics from one or more biometric sensors.

Further, one or more steps of the method may be automatically initiated, maintained, and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g. the server computer, a client device, etc.) corresponding to the performance of the one or more steps, environmental variables (e.g. temperature, humidity, pressure, wind speed, lighting, sound, etc.) associated with a device corresponding to the performance of the one or more steps, physical state and/or physiological state and/or psychological state of the user, physical state (e.g. motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g. a real-time clock), a location sensor (e.g. a GPS receiver, a GLONASS receiver, an indoor location sensor, etc.), a biometric sensor (e.g. a fingerprint sensor), an environmental variable sensor (e.g. temperature sensor, humidity sensor, pressure sensor, etc.) and a device state sensor (e.g. a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part. Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g. initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Further, one or more steps of the method may be performed at one or more spatial locations. For instance, the method may be performed by a plurality of devices interconnected through a communication network. Accordingly, in an example, one or more steps of the method may be performed by a server computer. Similarly, one or more steps of the method may be performed by a client computer. Likewise, one or more steps of the method may be performed by an intermediate entity such as, for example, a proxy server. For instance, one or more steps of the method may be performed in a distributed fashion across the plurality of devices in order to meet one or more objectives. For example, one objective may be to provide load balancing between two or more devices. Another objective may be to restrict a location of one or more of an input data, an output data, and any intermediate data therebetween corresponding to one or more steps of the method. For example, in a client-server environment, sensitive data corresponding to a user may not be allowed to be transmitted to the server computer. Accordingly, one or more steps of the method operating on the sensitive data and/or a derivative thereof may be performed at the client device.

Overview

The present disclosure describes methods, systems, apparatuses, and devices for facilitating cleaning of a pool.

Further, the present disclosure describes a return jet specifically designed for a swimming pool having an angled nozzle for rotating the whole of the water within the swimming pool using a flow of the water from the circulation pump fitted to a consecutive dilution system (filtration system) of the swimming pool to drive the rotation of the water.

Further, the present disclosure describes an angled return jet that is used to automatically clean a swimming pool by the usage of the water rotation and the consecutive dilution system.

Further, the present disclosure describes an angled return jet which is a fitting that provides the rotation of the water of the swimming pool through water flow rather than squirting the return water through a restricted outlet.

Further, the present disclosure describes an angled return jet that pushes water along the walls of the swimming pool and down to the depths of the swimming pool causing the water in the swimming pool to rotate. Further, the rotating of the water causes rotation at the surface of the water. Further, the rotation causes a centrifugal force on the water pushing debris to the walls and taking the debris around the walls of the swimming pool and into the skimmers or entrance to the filtration system. The rotation of the water also cleans the walls of the swimming pool. Further, the angled return jet has a larger opening with an adjustable jet to replace the eyeball fittings used in swimming pools. The angled nature of the jet pushes water horizontally around the walls of the swimming pool causing the whole water of the pool to rotate in a stirring motion. The rotation of the water is caused by the water coming out of the return jet pushing along the walls. This follows the Newtonian laws of rotation as the constant flow of the water applies a continuous rotating force to the volume of water within the swimming pool. The rotation is a result of the angled force of the return jet acting around an unseen moveable pivot somewhere in the center of the swimming pool. This pivot point is not fixed but is formed in a similar way to a whirlpool by the force acting upon the edges of the water. There is almost no restriction of mass within the walls and floor to the water rotation. Over a period of time, the whole of the water will be rotating. This occurs during the filtration systems requirement of 8 to 10 hours of filtration per day for clean water. As the water rotates it starts at the surface and slowly as it acquires the spin it moves into the deeper water whilst maintaining the spin at the surface. This can be considered as applying to Poiseuille's Law of viscosity and laminar flow. By utilizing the full force and flow rate of the circulation pump by not restricting the outlet as with squirting devices, more torque is created to spin or rotate the water. This sizing of the outlet jet is based on maximum flow with minimum restriction. The sizing matches the skimmer's inlet so no restriction is created within the system so full suction into the consecutive dilution system from the skimmer entrance is achieved.

The rotation or spin applied to the water has many advantages. The rotation moves the water at depths and fully mixes the disinfectant; this is especially true when used in conjunction with chlorinators where the freshly chlorinated water is pushed ever deeper into the water. The second advantage is the rotation at the surface of the water pushes any floating debris to the edges of the pool through centrifugal force and then the debris is pushed along the walls and to the mouth of the skimmer where it enters the mouth of the skimmer and enters the consecutive dilution system.

As skimmers have a limited suction, approximately 8 to 10 inches from the mouth opening, unless organic waste and debris are deposited in front of the skimmer it will not be taken into the consecutive dilution system and will sink and decompose. By rotating the water the debris is pulled around the swimming pool's walls until it passes the skimmer's mouth close enough to be sucked in. This reduces the organic waste within the pool, in test pools the rotation has been shown to fully clean the pool, and the need for hand nets or hand skimmer nets is reduced to zero.

By rotating the water with a slight downward thrust all clean filtered water is pushed downwards and away from the skimmers leaving new dirty water from the depths to be cleaned. By reducing the pressure and increasing the flow the pressure on the circulation pump is reduced as it is on all of the systems, this increases the flow suction at both the skimmers and the main drain meaning the swimming pool's water turnover rate is increased so reducing the pump on time to save electricity.

Heated water by its nature rises to the surface, by directing the water returning to the swimming pool slightly downwards the warmer water that is skimmed from the surface by the skimmers and returned to the pool is pushed downwards so mixing the heated water throughout. Further, the usage of a heating system increases the efficiency of heating the swimming pool and further reduces the cost of energy for pool owners.

By rotating the water, the lower region of the water in the swimming pool is disturbed which by its nature mixes the disinfectant and also raises algae spores from the bottom of the swimming pool's floor. This has the effect of killing the spores before they can develop into fully grown reproducing algae. Rotation nips in the bud the development of algae within the pool. The rising nature of the rotation brings the algae spores to the surface and into the consecutive dilution system where they are trapped.

Further, the present disclosure describes the usage of the fitted consecutive dilution system for cleaning the pool and makes the whole thing efficient massively reducing the need to clean and maintain the swimming pool and increasing the safety and purity of the water.

Further, a threaded part of the angled return jet allows attaching it to the pipe work of the swimming pool where it exits the filtration system on the side wall of the swimming pool.

Further, a non-threaded part of the angled return jet allows push fitting it into the pipe work of the swimming pool where it exits the filtration system on a side wall of the swimming pool.

Further, the angled return jet may include a pivot system with a ball joint to alter the angle of the angled return jet in both the horizontal and the vertical positions.

Further, the angled return jet may include a smaller outlet for using it in swimming pools where two skimmers are fitted but for example four return pipes. The smaller sizes would allow for balancing the whole circulation system to remove the restriction to flow.

Further, the present disclosure describes a retrofit angled pipe that can be attached to the existing eyeball return by simply adding a ball joint with an outlet at an angle to replace the restricting and non-water rotating eyeball. The restriction is removed to increase total flow.

Figure 9:
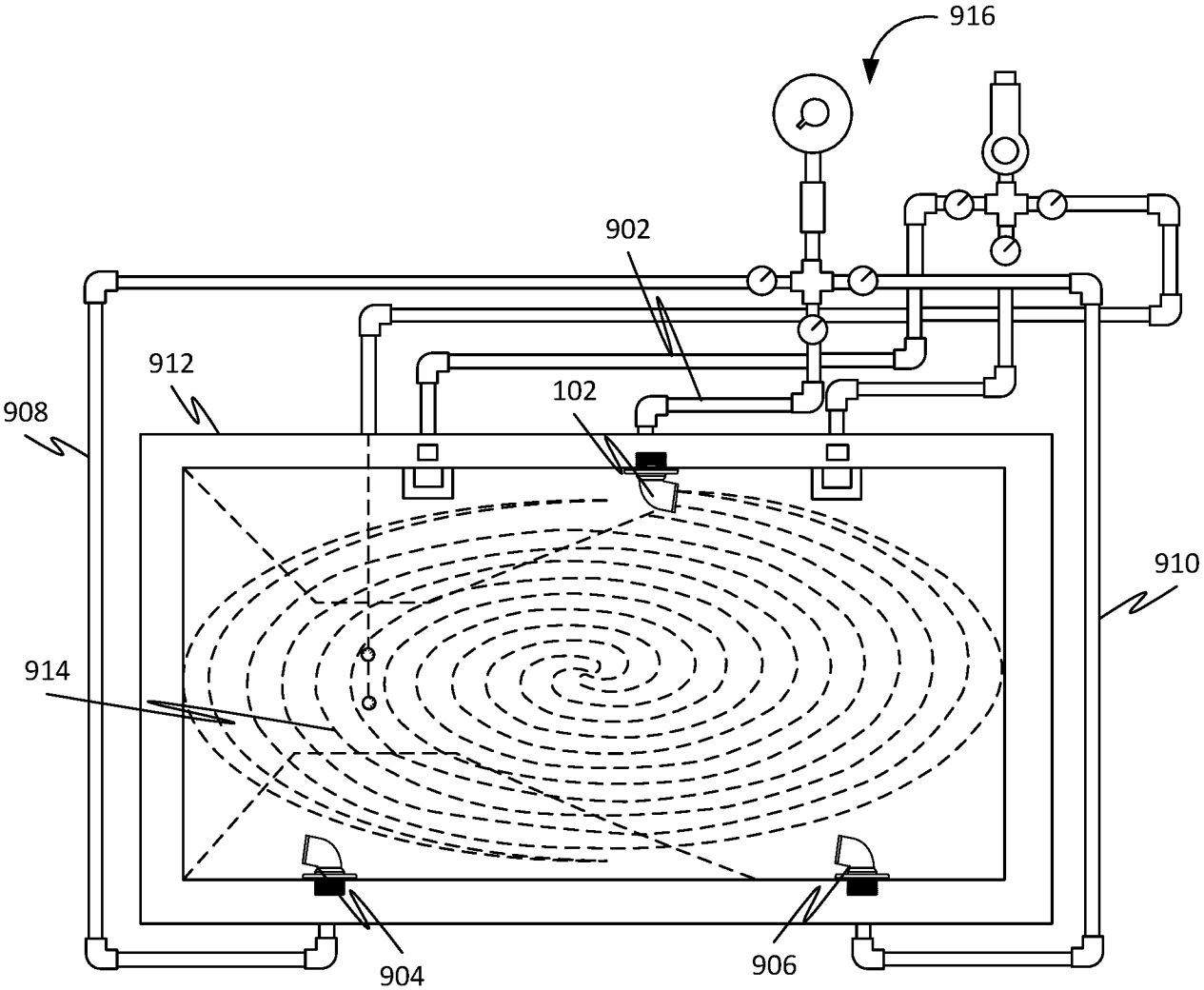
FIG. 9 is a top view of the pool with the at least one angled nozzle and at least two angled nozzles, in accordance with some embodiments.

FIG. 1 is a right side perspective view of an apparatus 100 for facilitating cleaning of a pool 912 (as shown in FIG. 9), in accordance with some embodiments. Further, the apparatus 100 may include at least one angled nozzle 102 disposed in the pool 912. Further, the at least one angled nozzle 102 may be configured to be attached to at least one return line 902 of a dilution system 916 of the pool 912. Further, each of the at least one return line 902 carries a first amount of water of the pool 912 from the dilution system 916 to each of the at least one angled nozzle 102 for dispensing the first amount of water into the pool 912. Further, the pool 912 may be a swimming pool. Further, each of the at least one angled nozzle 102 may include an inlet nozzle portion 104, an outlet nozzle portion 106, and a curved nozzle portion 108.

Further, the inlet nozzle portion 104 may be configured to be attached to an outlet portion of each of the at least one return line 902 to align an inlet opening 110 of the inlet nozzle portion 104 with an opening of the outlet portion for fluidly coupling each of the at least one angled nozzle 102 to each of the at least one return line 902.

Further, the outlet nozzle portion 106 may include an outlet opening 112.

Further, the curved nozzle portion 108 may be extending between the inlet nozzle portion 104 and the outlet nozzle portion 106. Further, the inlet nozzle portion 104, the outlet nozzle portion 106, and the curved nozzle portion 108 define an internal channel for fluidly coupling the inlet opening 110 with the outlet opening 112. Further, a central axis of the outlet nozzle portion 106 may be offset at an angle relative to a central axis of the inlet nozzle portion 104 based on the curved nozzle portion 108. Further, the angle may be at least one acute angle. Further, the first amount of water flows out of the outlet opening 112 in the pool 912 with at least one flow characteristic based on the angle. Further, the at least one flow characteristic may include a flow direction, a flow velocity, a flow laminarity, etc. Further, the flowing of the first amount of water in the pool 912 imparts a circular motion to a second amount of water present in the pool 912 with at least one motion characteristic based on the at least one flow characteristic of the first amount of water. Further, the at least one motion characteristic may include a position of a pivot around which the second amount of water moves, a velocity of the circular motion of the second amount of water, etc. Further, the second amount of water moving in the circular motion creates a whirlpool in the second amount of water. Further, the imparting of the circular motion to the second amount of water present in the pool 912 with the at least one motion characteristic facilitates the cleaning of the second amount of water present in the pool 912. Further, the second amount of water rotates based on the imparting of the circular motion to the second amount of water. Further, the cleaning may include pulling at least one debris in the second amount of water around at least one wall of the pool 912 until the at least one debris passes at least one mouth of at least one skimmer of the pool 912 based on the rotating of the second amount of water. Further, the cleaning may include mixing at least one disinfectant dispensed into the second amount of water based on the rotating of the second amount of water.

Further, in some embodiments, the outlet nozzle portion 106 may be fixedly coupled with the curved nozzle portion 108. Further, the curved nozzle portion 108 may be rotatably coupled with the inlet nozzle portion 104 using a ball joint mechanism 114. Further, the ball joint mechanism 114 allows the curved nozzle portion 108 to be rotated about the central axis of the inlet nozzle portion 104 between a plurality of first positions. Further, the at least one flow characteristic of the first amount of water flowing out of the outlet opening 112 in the pool 912 may be based on each of the plurality of first positions.

Further, in an embodiment, the ball joint mechanism 114 allows the curved nozzle portion 108 to be rotated about a first axis perpendicular to the central axis of the inlet nozzle portion 104 between a plurality of second positions. Further, the angle corresponds to each of the plurality of second positions.

Further, in an embodiment, the ball joint mechanism 114 allows the curved nozzle portion 108 to be rotated about a second axis perpendicular to the first axis and the central axis of the inlet nozzle portion 104 between a plurality of third positions. Further, the at least one flow characteristic of the first amount of water flowing out of the outlet opening 112 in the pool 912 may be based on each of the plurality of third positions.

Figure 2:
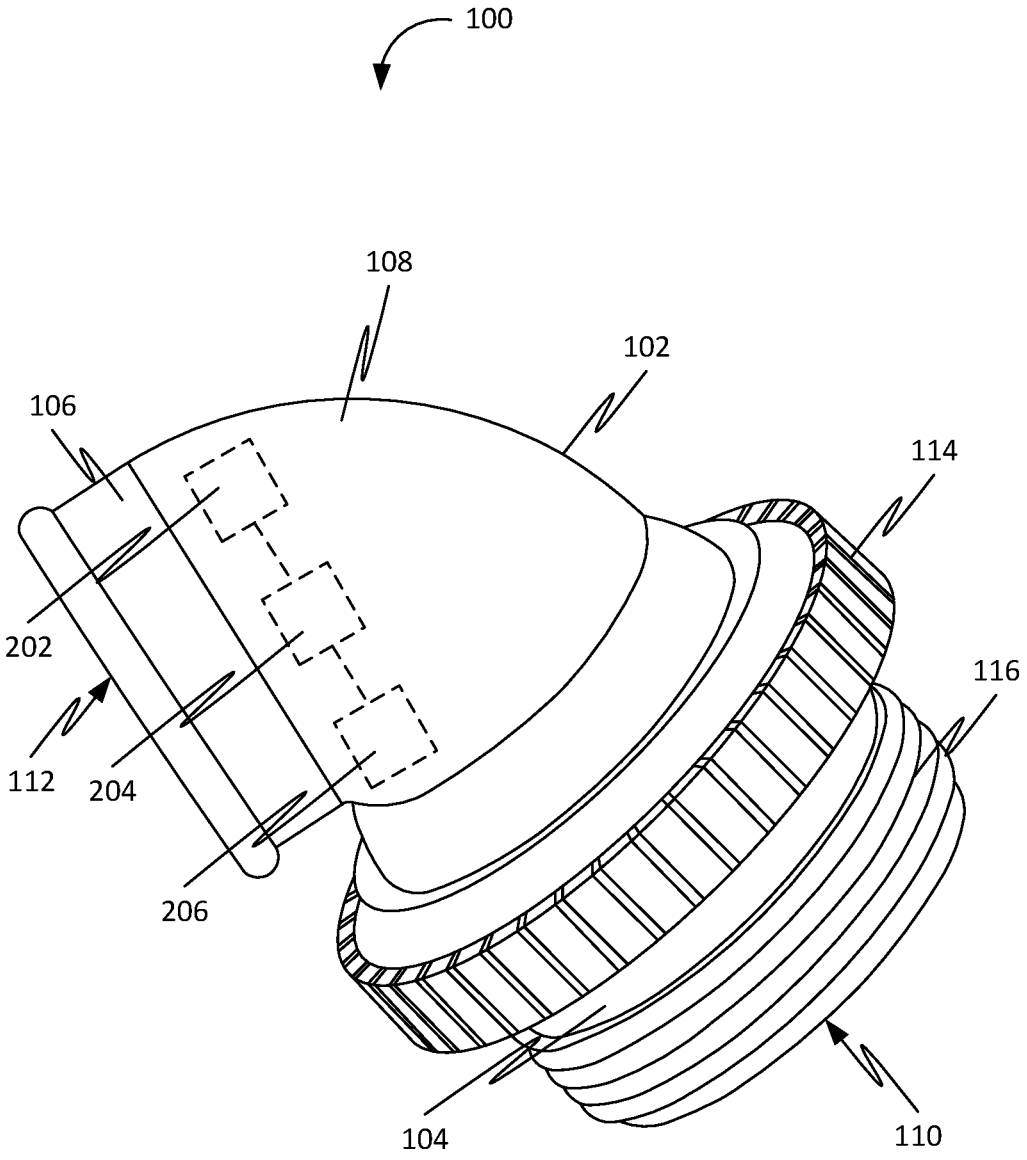
FIG. 2 is a right side perspective view of the apparatus, in accordance with some embodiments.

In further embodiments, the apparatus 100 may include at least one sensor 202, a processing device 204, and at least one actuator 206, as shown in FIG. 2. Further, the at least one sensor 202 may be configured for generating at least one sensor data based on detecting an amount of water present in the pool 912. Further, the processing device 204 may be communicatively coupled with the at least one sensor 202. Further, the processing device 204 may be configured for analyzing the at least one sensor data. Further, the processing device 204 may be configured for determining at least one of at least one first position from the plurality of first positions, at least one second position from the plurality of second positions, and at least one third position from the plurality of third positions for the at least one angled nozzle 102 based on the analyzing of the at least one sensor data. Further, the processing device 204 may be configured for generating at least one command for rotating the at least one angled nozzle 102 to at least one of the at least one first position, the at least one second position, and the at least one third position based on the determining. Further, the at least one actuator 206 may be disposed on the at least one angled nozzle 102. Further, the at least one actuator 206 may be communicatively coupled with the processing device 204. Further, the at least one actuator 206 may be operatively coupled with the ball joint mechanism 114. Further, the at least one actuator 206 may be configured for rotating the curved nozzle portion 108 of each of the at least one angled nozzle 102 to at least one of the at least one first position, the at least one second position, and the at least one third position based on the at least one command.

Further, in an embodiment, the processing device 204 may be configured for generating a status of the pool 912 based on the analyzing. Further, the processing device 204 may be communicatively coupled with a communication device. Further, the communication device may be configured for transmitting the status to at least one user device.

Figure 3:
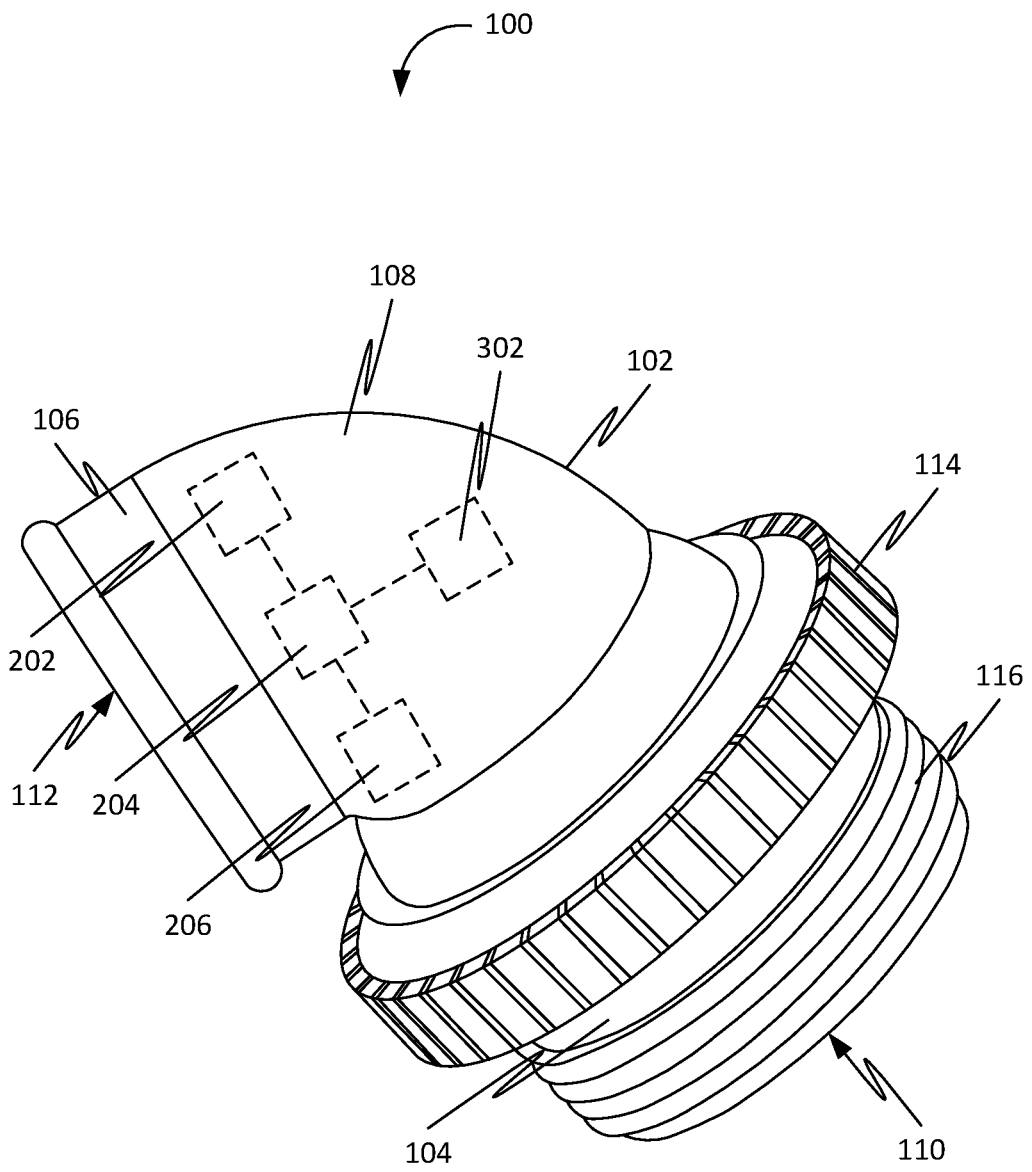
FIG. 3 is a right side perspective view of the apparatus, in accordance with some embodiments.

In further embodiments, the apparatus 100 may include at least one first sensor 302, as shown in FIG. 3. Further, the at least one first sensor 302 may be communicatively coupled with the processing device 204. Further, the at least one first sensor 302 may be configured for generating at least one first sensor data based on detecting a vertical distance from the at least one angled nozzle 102 to a water level of the second amount of water present in the pool 912. Further, the processing device 204 may be configured for analyzing the at least one first sensor data. Further, the determining for at least one of the at least one first position from the plurality of first positions, the at least one second position from the plurality of second positions, and the at least one third position from the plurality of third positions for the curved nozzle portion 108 of each of the at least one angled nozzle 102 may be further based on the analyzing of the at least one first sensor data.

Figure 4:
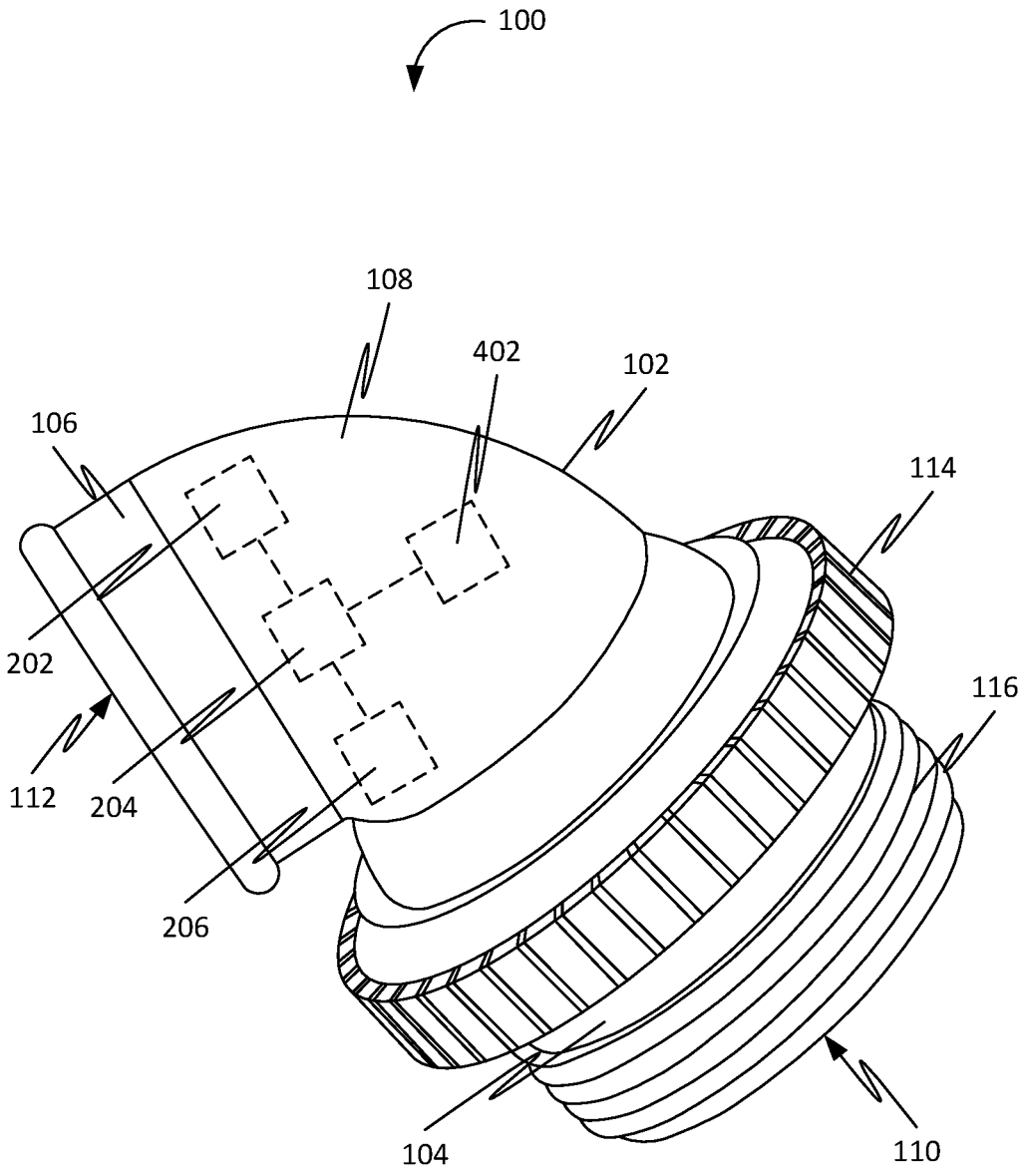
FIG. 4 is a right side perspective view of the apparatus, in accordance with some embodiments.

In further embodiments, the apparatus 100 may include at least one second sensor 402, as shown in FIG. 4. Further, the at least one second sensor 402 may be communicatively coupled with the processing device 204. Further, the at least one second sensor 402 may be configured for generating at least one second sensor data based on detecting a position of at least one contaminant in relation to each of the at least one angled nozzle 102. Further, the processing device 204 may be further configured for analyzing the at least one second sensor data. Further, the determining for at least one of the at least one first position from the plurality of first positions, the at least one second position from the plurality of second positions, and the at least one third position from the plurality of third positions for the curved nozzle portion 108 of each of the at least one angled nozzle 102 may be further based on the analyzing of the at least one second sensor data. Further, the at least one contaminant may include the at least one debris.

Figure 5:
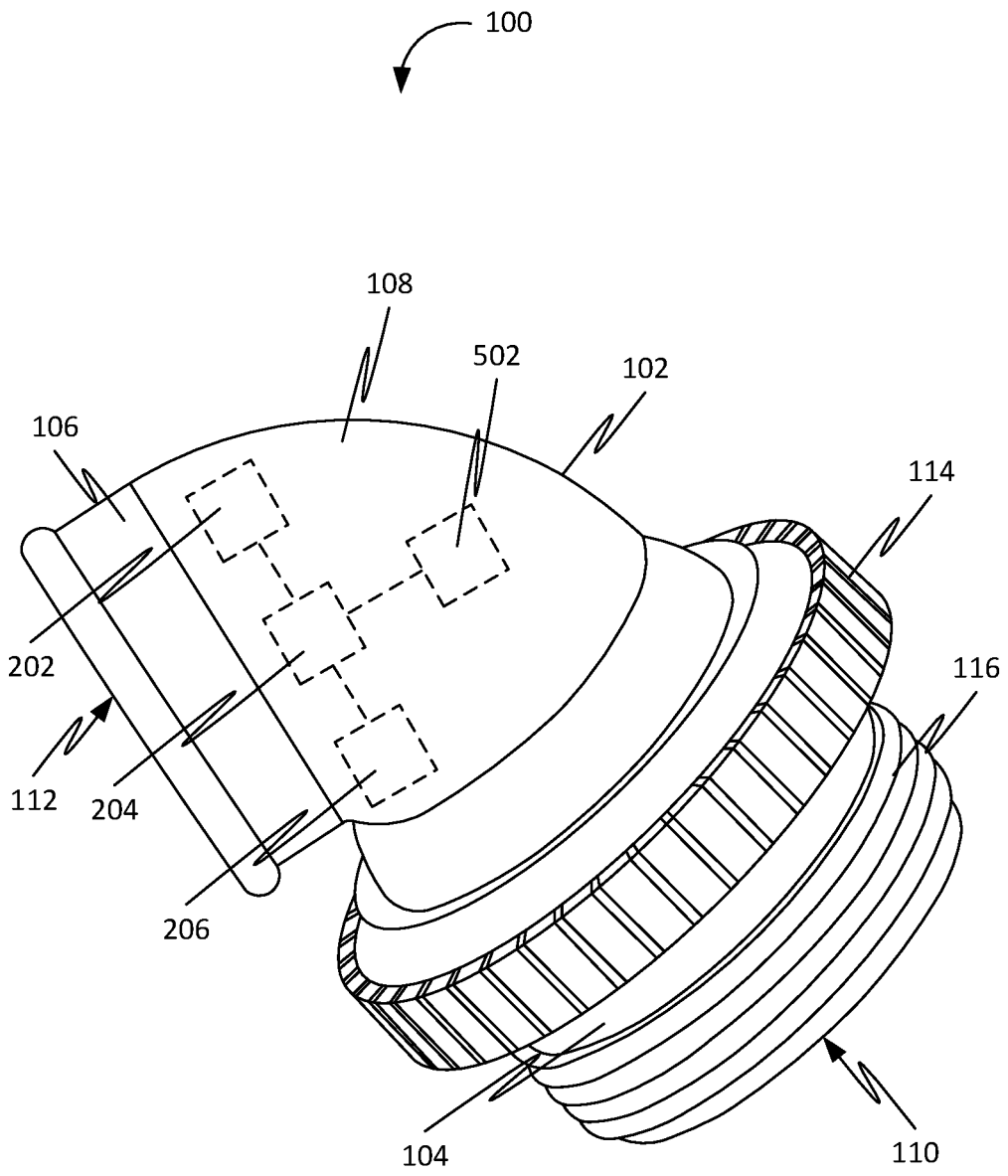
FIG. 5 is a right side perspective view of the apparatus, in accordance with some embodiments.

In further embodiments, the apparatus 100 may include at least one third sensor 502, as shown in FIG. 5. Further, the at least one third sensor 502 may be communicatively coupled with the processing device 204. Further, the at least one third sensor 502 may be configured for generating at least one third sensor data based on detecting a vertical distance from the at least one angled nozzle 102 to a floor 914 of the pool 912. Further, the processing device 204 may be configured for analyzing the at least one third sensor data. Further, the determining for at least one of the at least one first position from the plurality of first positions, the at least one second position from the plurality of second positions, and the at least one third position from the plurality of third positions for the curved nozzle portion 108 of each of the at least one angled nozzle 102 may be further based on the analyzing of the at least one third sensor data.

Figure 6:
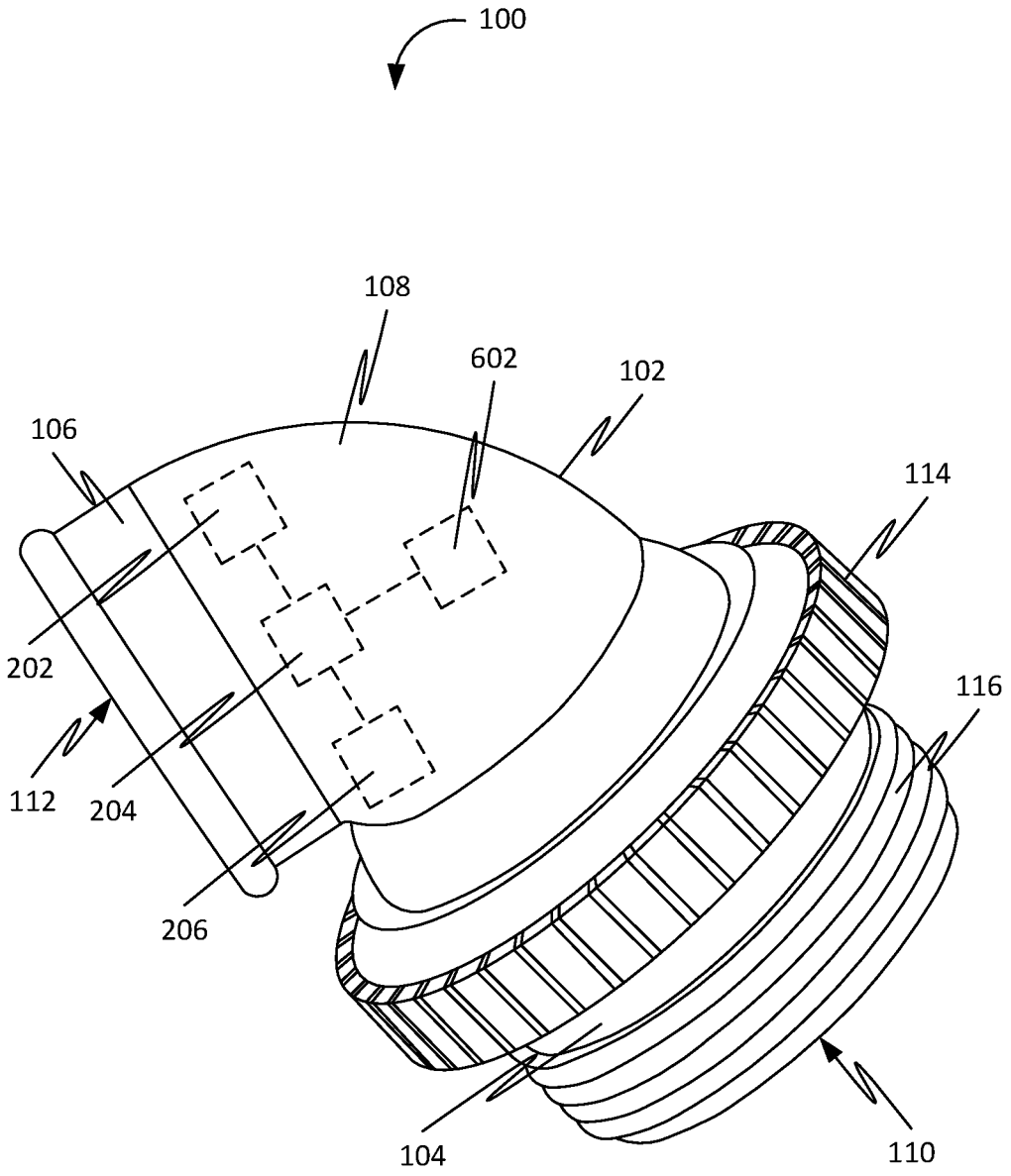
FIG. 6 is a right side perspective view of the apparatus, in accordance with some embodiments.

In further embodiments, the apparatus 100 may include at least one fluid sensor 602, as shown in FIG. 6. Further, the at least one fluid sensor 602 may be communicatively coupled with the processing device 204. Further, the at least one fluid sensor 602 may be configured for generating at least one fluid data based on detecting at least one fluid characteristic of the first amount of water. Further, the at least one fluid characteristic may include a temperature, a pressure, etc. of the first amount of water. Further, the processing device 204 may be configured for analyzing the at least one fluid data. Further, the determining for at least one of the at least one first position from the plurality of first positions, the at least one second position from the plurality of second positions, and the at least one third position from the plurality of third positions for the curved nozzle portion 108 of each of the at least one angled nozzle 102 may be based on the analyzing of the at least one fluid data.

Figure 7:
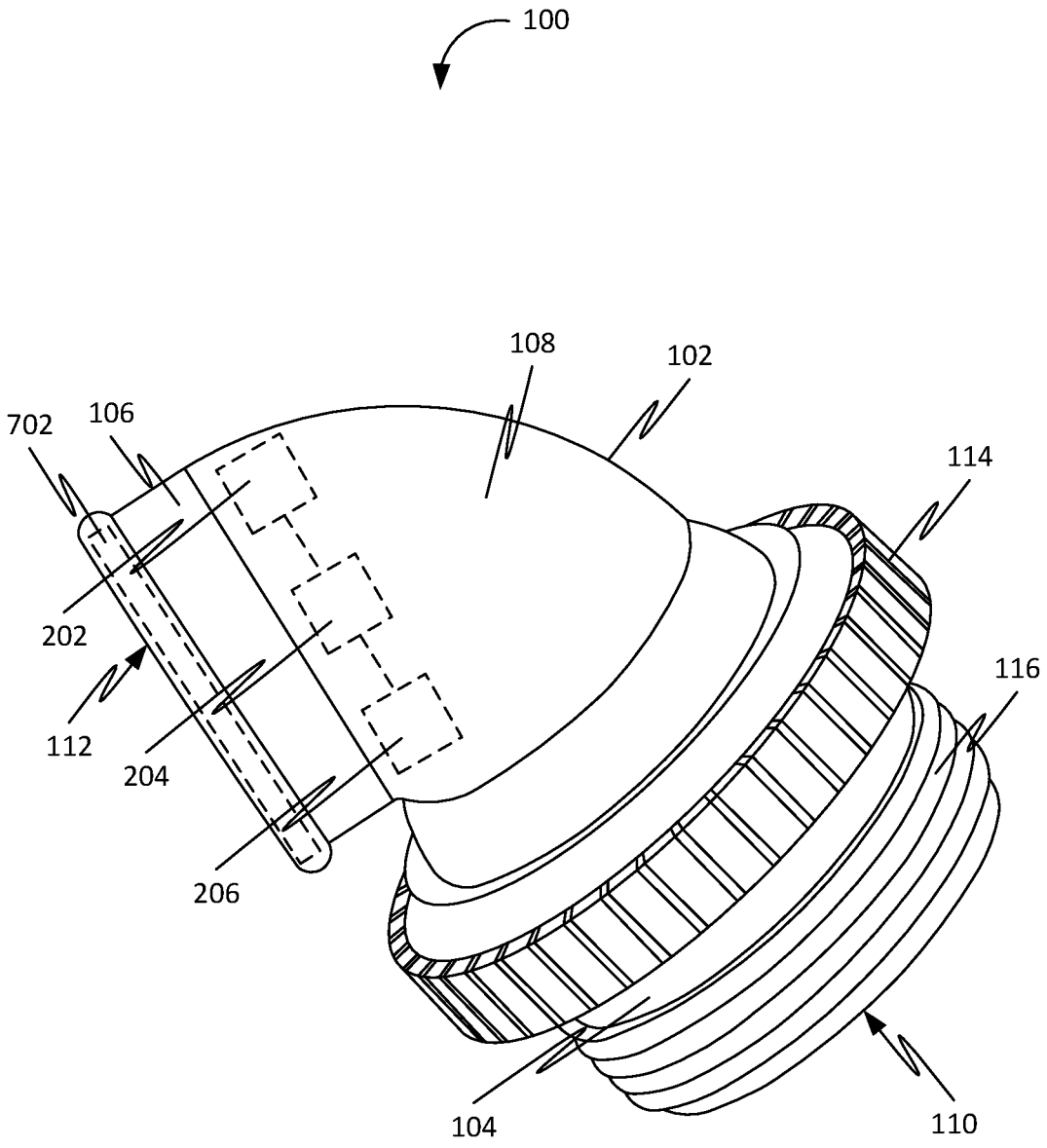
FIG. 7 is a right side perspective view of the apparatus, in accordance with some embodiments.

Further, in some embodiments, the outlet nozzle portion 106 may include at least one shutter 702, as shown in FIG. 7, disposed around the outlet opening 112. Further, the at least one shutter 702 may be configured to be retractably extended between a plurality of shutter positions. Further, the plurality of shutter positions corresponds to a plurality of opening areas of the outlet opening 112. Further, the at least one flow characteristic of the first amount of water flowing out of the outlet opening 112 in the pool 912 may be based on each of the plurality of opening areas.

In further embodiments, Further, the at least one sensor 202 may be configured for generating at least one sensor data based on detecting an amount of water present in the pool 912. Further, the processing device 204 may be communicatively coupled with the at least one sensor 202. Further, the processing device 204 may be configured for analyzing the at least one sensor data. Further, the processing device 204 may be configured for determining an opening area from the plurality of opening areas for the outlet opening 112 based on the analyzing of the at least one sensor data. Further, the opening area corresponds to a shutter position of the plurality of shutter positions. Further, the processing device 204 may be configured for generating at least one first command for extending the at least one shutter 702 to the shutter position based on the determining of the opening area. Further, the at least one actuator 206 disposed on the at least one angled nozzle 102. Further, the at least one actuator 206 may be communicatively coupled with the processing device 204. Further, the at least one actuator 206 may be operatively coupled with the at least one shutter 702. Further, the at least one actuator 206 may be configured for extending the at least one shutter 702 to the shutter position based on the at least one first command.

Further, in some embodiments, the inlet nozzle portion 104 may include at least one thread 116 disposed on an exterior surface of the inlet nozzle portion 104. Further, the inlet nozzle portion 104 threadedly engages with the outlet portion of each of the at least one return line 902 for attaching each of the at least one angled nozzle 102 to each of the at least one return line 902.

Further, in some embodiments, the inlet nozzle portion 104 receives the outlet portion of each of the at least one return line 902 for attaching each of the at least one angled nozzle 102 to each of the at least one return line 902.

FIG. 2 is a right side perspective view of the apparatus 100, in accordance with some embodiments.

FIG. 3 is a right side perspective view of the apparatus 100, in accordance with some embodiments.

FIG. 4 is a right side perspective view of the apparatus 100, in accordance with some embodiments.

FIG. 5 is a right side perspective view of the apparatus 100, in accordance with some embodiments.

FIG. 6 is a right side perspective view of the apparatus 100, in accordance with some embodiments.

FIG. 7 is a right side perspective view of the apparatus 100, in accordance with some embodiments.

Figure 8:
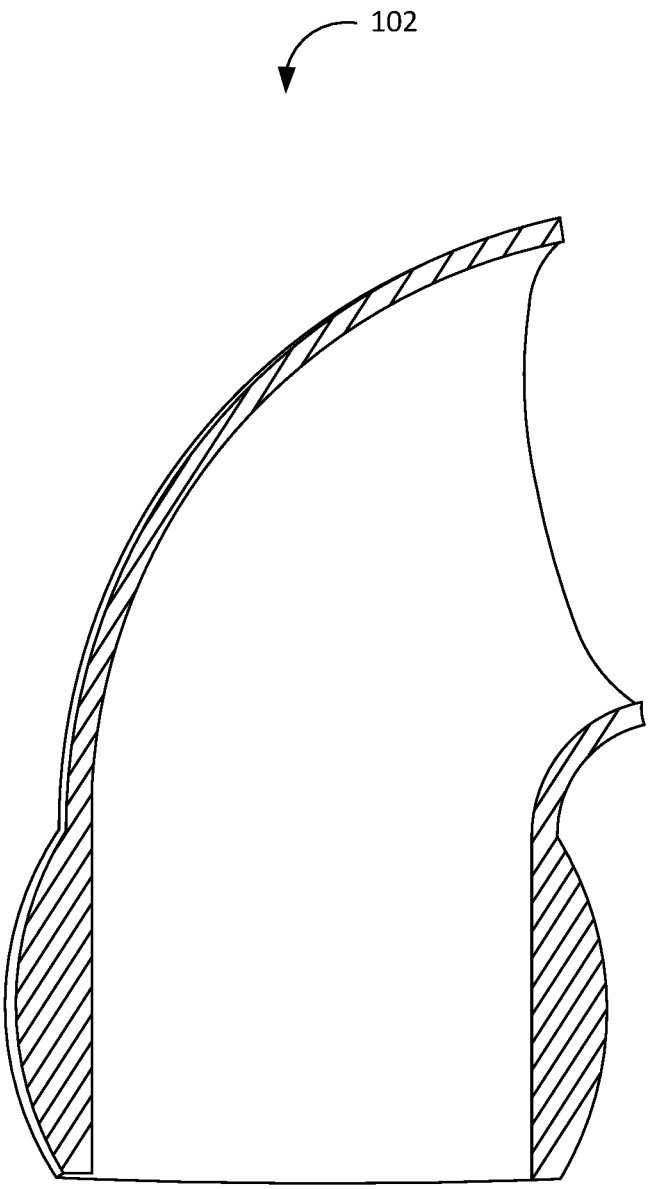
FIG. 8 is a cross-sectional view of the at least one angled nozzle, in accordance with some embodiments.

FIG. 8 is a cross-sectional view of the at least one angled nozzle 102, in accordance with some embodiments.

FIG. 9 is a top view of the pool 912 with the at least one angled nozzle 102 and at least two angled nozzles 904-906, in accordance with some embodiments. Further, the at least two angled nozzles 904-906 may be configured to be attached to at least two return lines 908-910 of the dilution system 916 of the pool 912.

Figure 10:
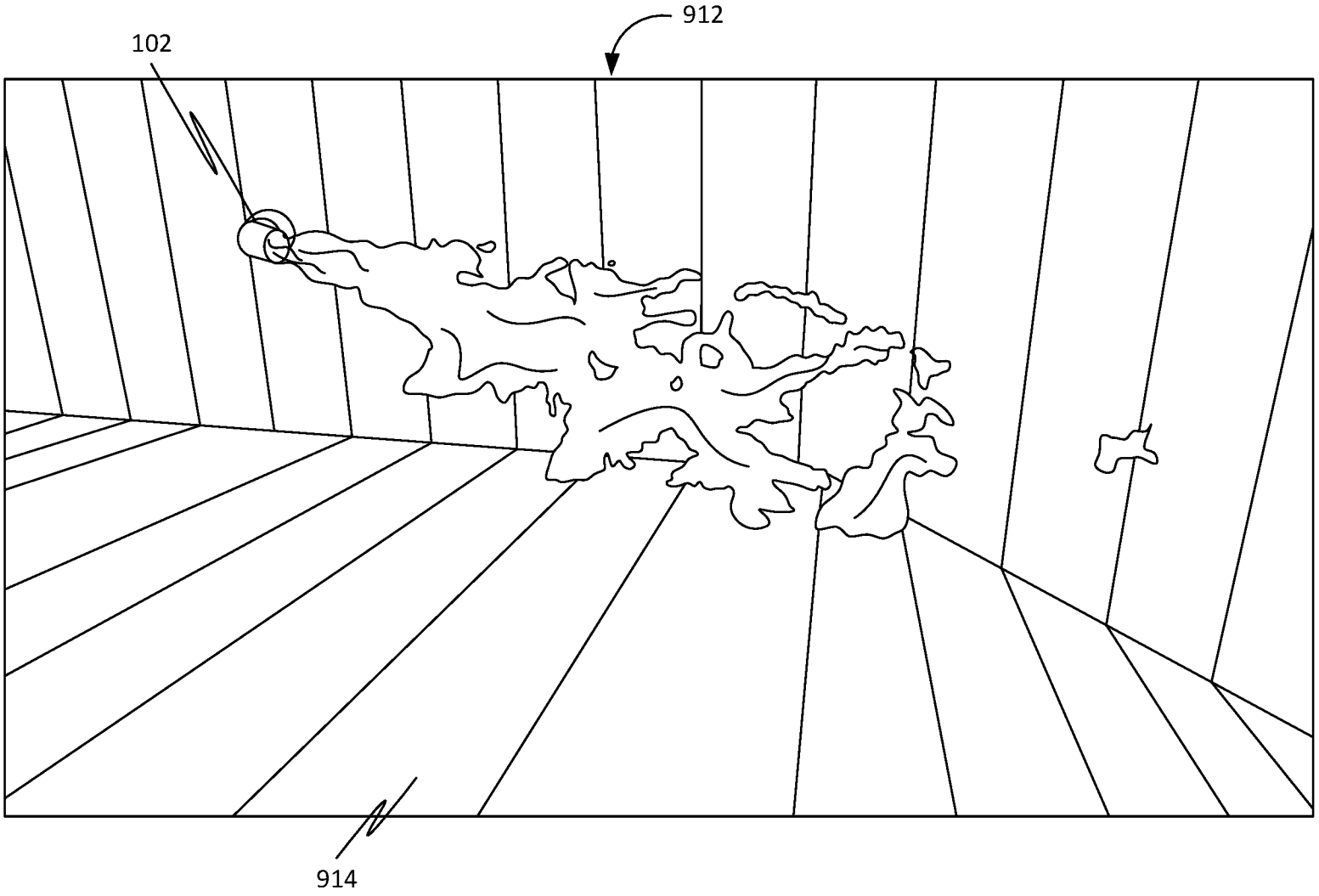
FIG. 10 is a partial cross-sectional view of the pool with the at least one angled nozzle, in accordance with some embodiments.

FIG. 10 is a partial cross-sectional view of the pool 912 with the at least one angled nozzle 102, in accordance with some embodiments.

Figure 11:
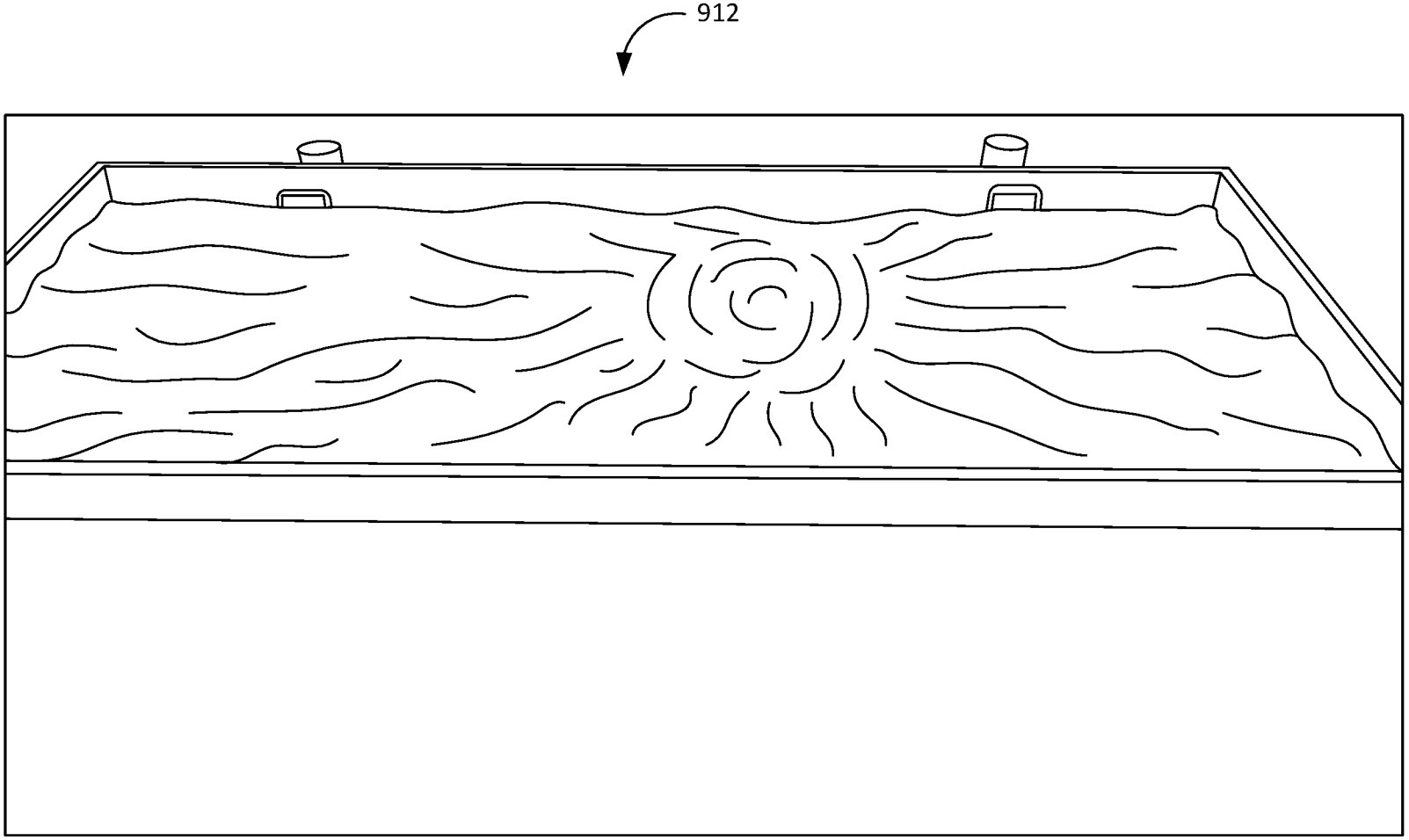
FIG. 11 is a front perspective view of the pool, in accordance with some embodiments.

FIG. 11 is a front perspective view of the pool 912, in accordance with some embodiments.

Figure 12:
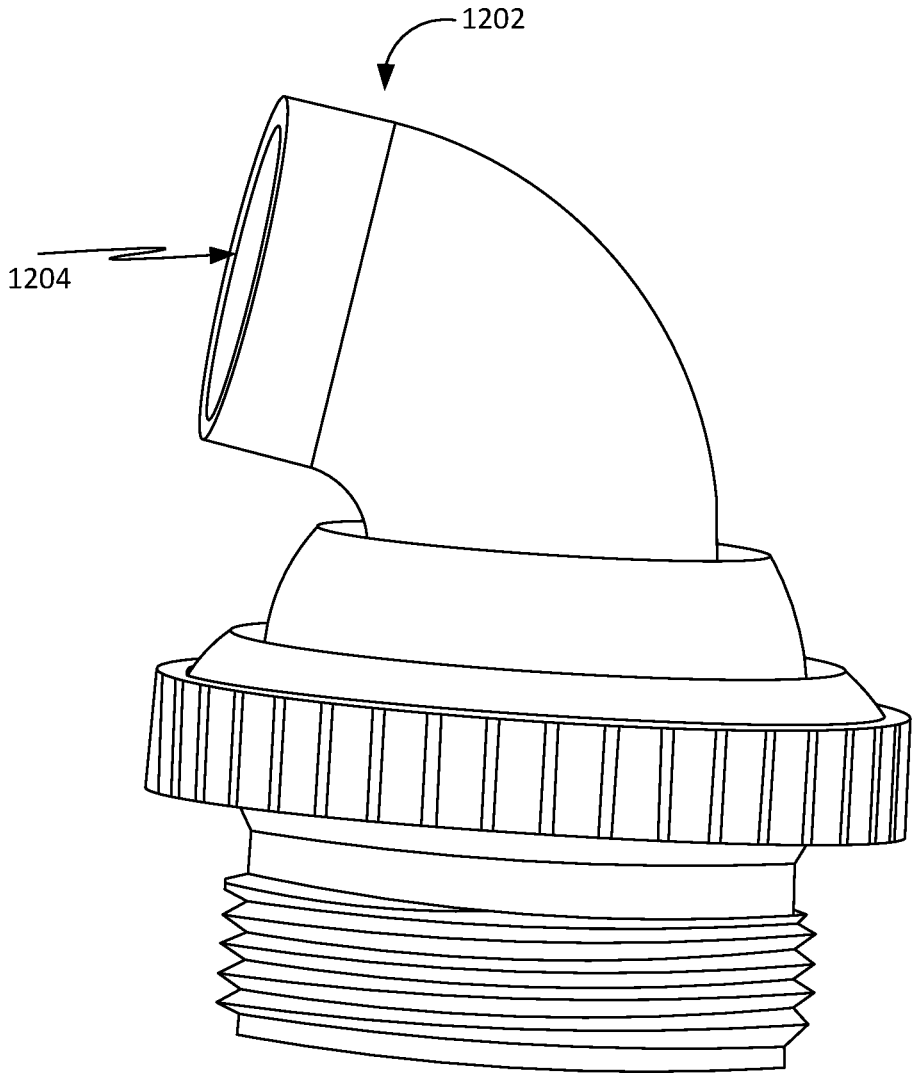
FIG. 12 is a front view of at least one angled nozzle of the apparatus, in accordance with some embodiments.

FIG. 12 is a front view of at least one angled nozzle 1202 of the apparatus 100, in accordance with some embodiments. Further, an area of an outlet opening 1204 of the at least one angled nozzle 1202 may be smaller than an area of the outlet opening 112 of the at least one angled nozzle 102.

Figure 13:
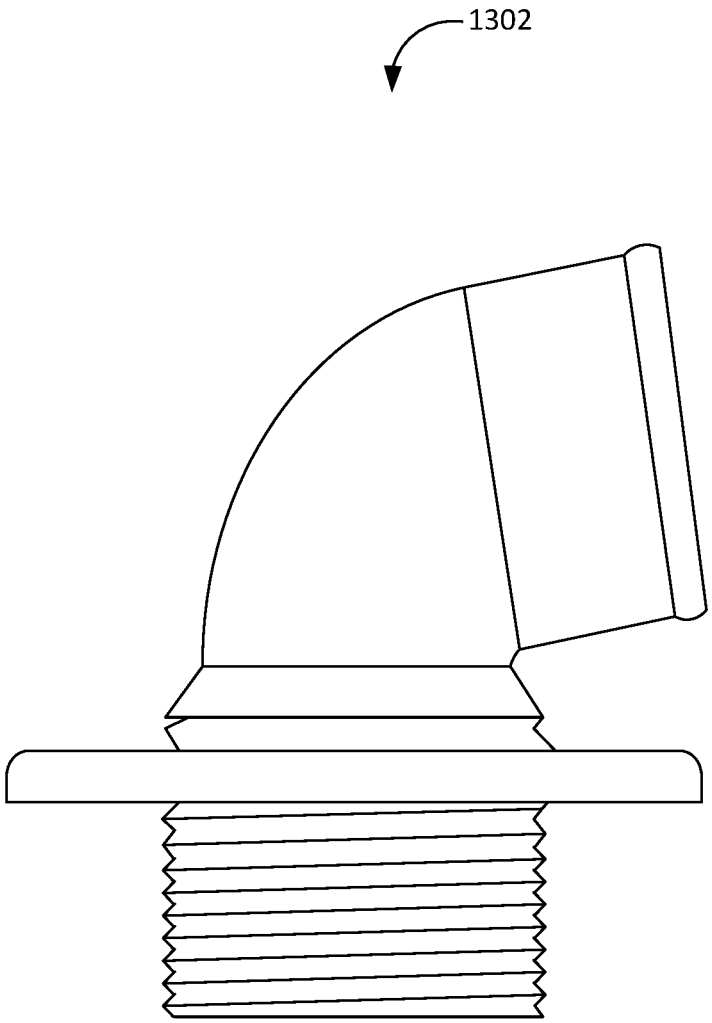
FIG. 13 is a left side view of at least one angled nozzle of the apparatus, in accordance with some embodiments.

FIG. 13 is a left side view of at least one angled nozzle 1302 of the apparatus 100, in accordance with some embodiments.

Figure 14:
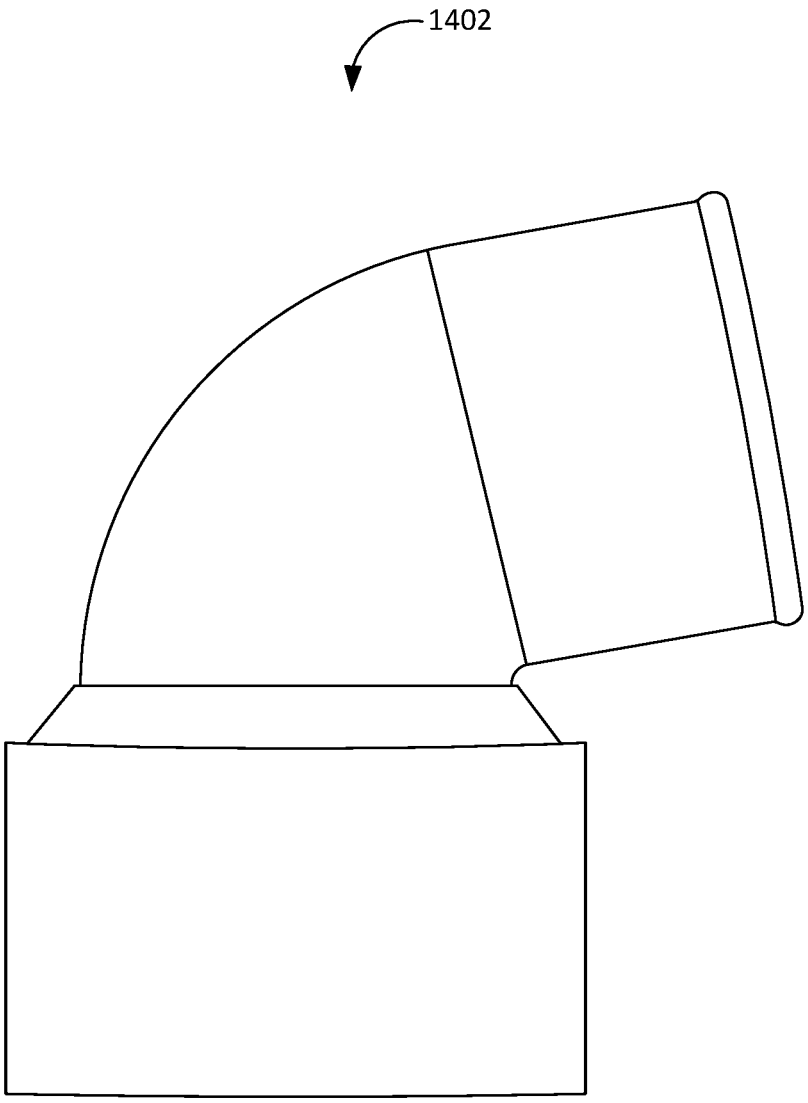
FIG. 14 is a left side view of at least one angled nozzle of the apparatus, in accordance with some embodiments.

FIG. 14 is a left side view of at least one angled nozzle 1402 of the apparatus 100, in accordance with some embodiments.

Figure 15:
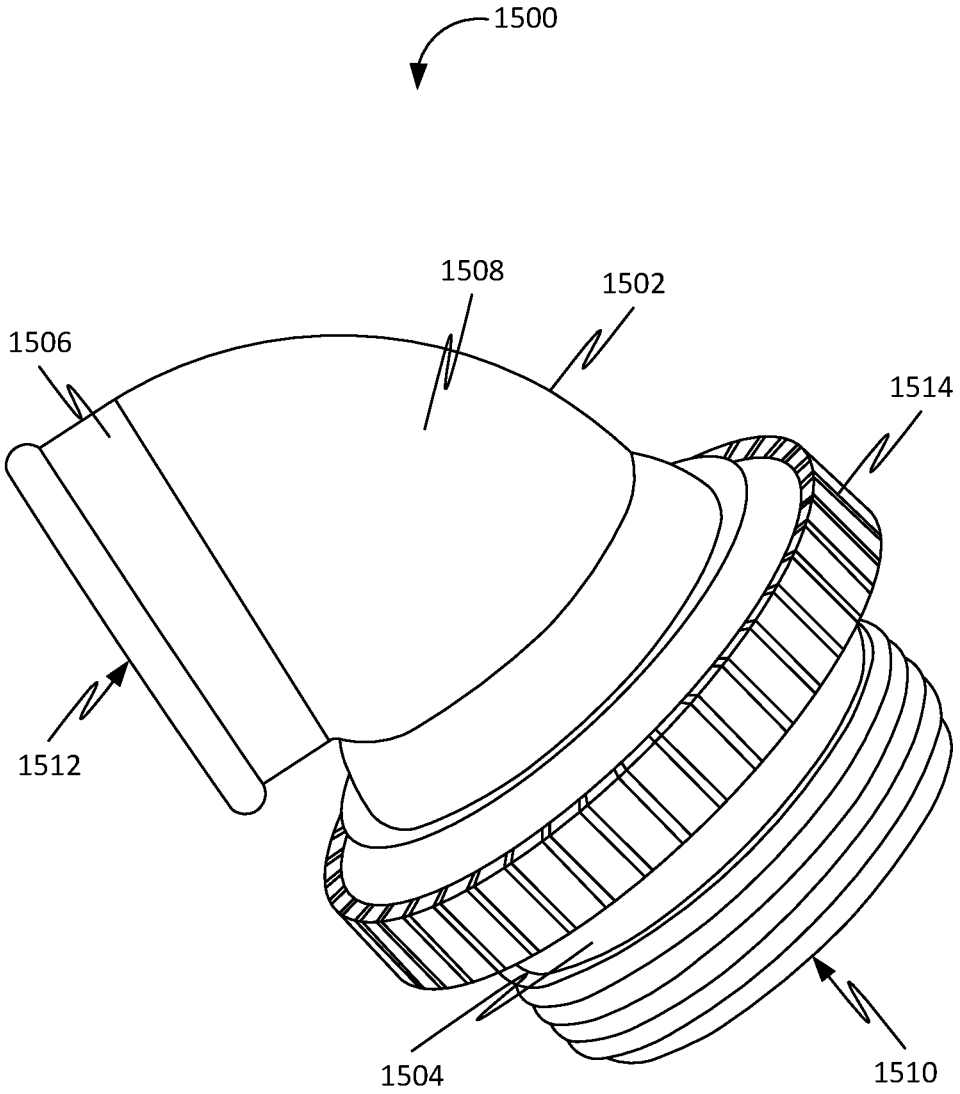
FIG. 15 is a right side perspective view of an apparatus for facilitating cleaning of a pool, in accordance with some embodiments.

FIG. 15 is a right side perspective view of an apparatus 1500 for facilitating cleaning of a pool, in accordance with some embodiments. Further, the apparatus 1500 may include at least one angled nozzle 1502 disposed in the pool. Further, the at least one angled nozzle 1502 may be configured to be attached to at least one return line of a dilution system of the pool. Further, each of the at least one return line carries a first amount of water of the pool from the dilution system to each of the at least one angled nozzle 1502 for dispensing the first amount of water into the pool. Further, each of the at least one angled nozzle 1502 may include an inlet nozzle portion 1504, an outlet nozzle portion 1506, and a curved nozzle portion 1508.

Further, the inlet nozzle portion 1504 may be configured to be attached to an outlet portion of each of the at least one return line to align an inlet opening 1510 of the inlet nozzle portion 1504 with an opening of the outlet portion for fluidly coupling each of the at least one angled nozzle 1502 to each of the at least one return line.

Further, the outlet nozzle portion 1506 may include an outlet opening 1512.

Further, the curved nozzle portion 1508 may be extending between the inlet nozzle portion 1504 and the outlet nozzle portion 1506. Further, the inlet nozzle portion 1504, the outlet nozzle portion 1506, and the curved nozzle portion 1508 define an internal channel for fluidly coupling the inlet opening 1510 with the outlet opening 1512. Further, a central axis of the outlet nozzle portion 1506 may be offset at an angle relative to a central axis of the inlet nozzle portion 1504 based on the curved nozzle portion 1508. Further, the angle may be at least one acute angle. Further, the first amount of water flows out of the outlet opening 1512 in the pool with at least one flow characteristic based on the angle. Further, the flowing of the first amount of water in the pool imparts a circular motion to a second amount of water present in the pool with at least one motion characteristic based on the at least one flow characteristic of the first amount of water. Further, the imparting of the circular motion to the second amount of water present in the pool with the at least one motion characteristic facilitates the cleaning of the second amount of water present in the pool. Further, the outlet nozzle portion 1506 may be fixedly coupled with the curved nozzle portion 1508. Further, the curved nozzle portion 1508 may be rotatably coupled with the inlet nozzle portion 1504 using a ball joint mechanism 1514. Further, the ball joint mechanism 1514 allows the curved nozzle portion 1508 to be rotated about the central axis of the inlet nozzle portion 1504 between a plurality of first positions. Further, the at least one flow characteristic of the first amount of water flowing out of the outlet opening 1512 in the pool may be based on each of the plurality of first positions.

Further, in some embodiments, the ball joint mechanism 1514 allows the curved nozzle portion 1508 to be rotated about a first axis perpendicular to the central axis of the inlet nozzle portion 1504 between a plurality of second positions. Further, the angle corresponds to each of the plurality of second positions.

Further, in an embodiment, the ball joint mechanism 1514 allows the curved nozzle portion 1508 to be rotated about a second axis perpendicular to the first axis and the central axis of the inlet nozzle portion 1504 between a plurality of third positions. Further, the at least one flow characteristic of the first amount of water flowing out of the outlet opening 1512 in the pool may be based on each of the plurality of third positions.

In further embodiments, the apparatus 1500 may include at least one sensor, a processing device, and at least one actuator. Further, the at least one sensor may be configured for generating at least one sensor data based on detecting an amount of water present in the pool. Further, the processing device may be communicatively coupled with the at least one sensor. Further, the processing device may be configured for analyzing the at least one sensor data. Further, the processing device may be configured for determining at least one of at least one first position from the plurality of first positions, at least one second position from the plurality of second positions, and at least one third position from the plurality of third positions for the at least one angled nozzle 1502 based on the analyzing of the at least one sensor data. Further, the processing device may be configured for generating at least one command for rotating the at least one angled nozzle 1502 to at least one of the at least one first position, the at least one second position, and the at least one third position based on the determining. Further, the at least one actuator may be disposed on the at least one angled nozzle 1502. Further, the at least one actuator may be communicatively coupled with the processing device. Further, the at least one actuator may be operatively coupled with the ball joint mechanism 1514. Further, the at least one actuator may be configured for rotating the curved nozzle portion 1508 of each of the at least one angled nozzle 1502 to at least one of the at least one first position, the at least one second position, and the at least one third position based on the at least one command.

In further embodiments, the apparatus 1500 may include at least one first sensor. Further, the at least one first sensor may be communicatively coupled with the processing device. Further, the at least one first sensor may be configured for generating at least one first sensor data based on detecting a vertical distance from the at least one angled nozzle 1502 to a water level of the second amount of water present in the pool. Further, the processing device may be configured for analyzing the at least one first sensor data. Further, the determining for at least one of the at least one first position from the plurality of first positions, the at least one second position from the plurality of second positions, and the at least one third position from the plurality of third positions for the curved nozzle portion 1508 of each of the at least one angled nozzle 1502 may be based on the analyzing of the at least one first sensor data.

In further embodiments, the apparatus 1500 may include at least one second sensor. Further, the at least one second sensor may be communicatively coupled with the processing device. Further, the at least one second sensor may be configured for generating at least one second sensor data based on detecting a position of at least one contaminant in relation to each of the at least one angled nozzle 1502. Further, the processing device may be configured for analyzing the at least one second sensor data. Further, the determining for at least one of the at least one first position from the plurality of first positions, the at least one second position from the plurality of second positions, and the at least one third position from the plurality of third positions for the curved nozzle portion 1508 of each of the at least one angled nozzle 1502 may be based on the analyzing of the at least one second sensor data.

Figure 16:
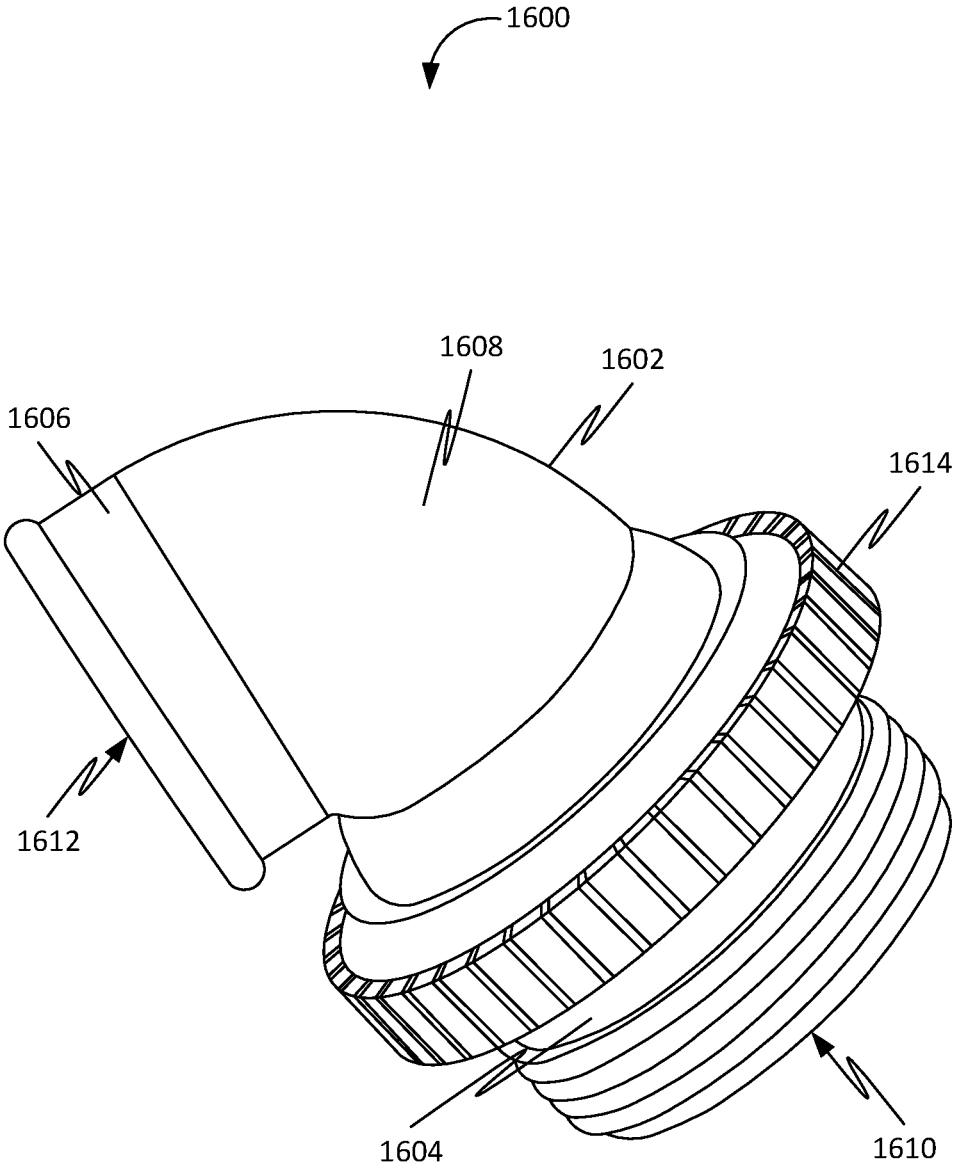
FIG. 16 is a right side perspective view of an apparatus for facilitating cleaning of a pool, in accordance with some embodiments.

FIG. 16 is a right side perspective view of an apparatus 1600 for facilitating cleaning of a pool, in accordance with some embodiments. Further, the apparatus 1600 may include at least one angled nozzle 1602 disposed in the pool. Further, the at least one angled nozzle 1602 may be configured to be attached to at least one return line of a dilution system of the pool. Further, each of the at least one return line carries a first amount of water of the pool from the dilution system to each of the at least one angled nozzle 1602 for dispensing the first amount of water into the pool. Further, each of the at least one angled nozzle 1602 may include an inlet nozzle portion 1604, an outlet nozzle portion 1606, and a curved nozzle portion 1608.

Further, the inlet nozzle portion 1604 may be configured to be attached to an outlet portion of each of the at least one return line to align an inlet opening 1610 of the inlet nozzle portion 1604 with an opening of the outlet portion for fluidly coupling each of the at least one angled nozzle 1602 to each of the at least one return line.

Further, the outlet nozzle portion 1606 may include an outlet opening 1612.

Further, the curved nozzle portion 1608 may be extending between the inlet nozzle portion 1604 and the outlet nozzle portion 1606. Further, the inlet nozzle portion 1604, the outlet nozzle portion 1606, and the curved nozzle portion 1608 define an internal channel for fluidly coupling the inlet opening 1610 with the outlet opening 1612. Further, a central axis of the outlet nozzle portion 1606 may be offset at an angle relative to a central axis of the inlet nozzle portion 1604 based on the curved nozzle portion 1608. Further, the angle may be at least one acute angle. Further, the first amount of water flows out of the outlet opening 1612 in the pool with at least one flow characteristic based on the angle. Further, the flowing of the first amount of water in the pool imparts a circular motion to a second amount of water present in the pool with at least one motion characteristic based on the at least one flow characteristic of the first amount of water. Further, the imparting of the circular motion to the second amount of water present in the pool with the at least one motion characteristic facilitates the cleaning of the second amount of water present in the pool. Further, the outlet nozzle portion 1606 may be fixedly coupled with the curved nozzle portion 1608. Further, the curved nozzle portion 1608 may be rotatably coupled with the inlet nozzle portion 1604 using a ball joint mechanism 1614. Further, the ball joint mechanism 1614 allows the curved nozzle portion 1608 to be rotated about the central axis of the inlet nozzle portion 1604 between a plurality of first positions. Further, the at least one flow characteristic of the first amount of water flowing out of the outlet opening 1612 in the pool may be further based on each of the plurality of first positions. Further, the ball joint mechanism 1614 further allows the curved nozzle portion 1608 to be rotated about a first axis perpendicular to the central axis of the inlet nozzle portion 1604 between a plurality of second positions. Further, the angle corresponds to each of the plurality of second positions. Further, the ball joint mechanism 1614 further allows the curved nozzle portion 1608 to be rotated about a second axis perpendicular to the first axis and the central axis of the inlet nozzle portion 1604 between a plurality of third positions. Further, the at least one flow characteristic of the first amount of water flowing out of the outlet opening 1612 in the pool may be further based on each of the plurality of third positions.

Figure 17:
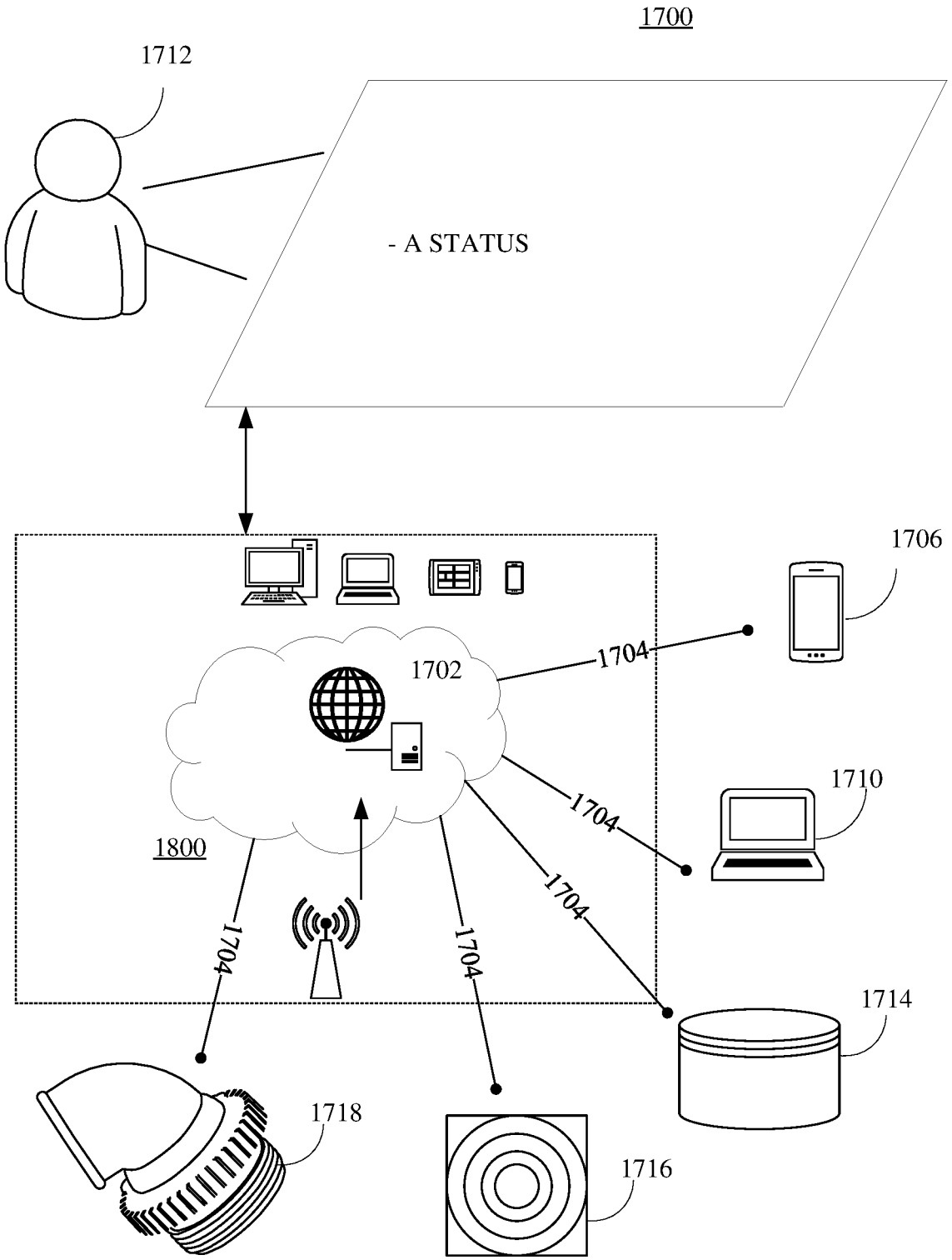
FIG. 17 is an illustration of an online platform consistent with various embodiments of the present disclosure.

FIG. 17 is an illustration of an online platform 1700 consistent with various embodiments of the present disclosure. By way of non-limiting example, the online platform 1700 to facilitate cleaning of a pool may be hosted on a centralized server 1702, such as, for example, a cloud computing service. The centralized server 1702 may communicate with other network entities, such as, for example, a mobile device 1706 (such as a smartphone, a laptop, a tablet computer, etc.), other electronic devices 1710 (such as desktop computers, server computers, etc.), databases 1714, sensors 1716, and an apparatus 1718 (such as the apparatus 100, the apparatus 1500, the apparatus 1600, etc.) over a communication network 1704, such as, but not limited to, the Internet. Further, users of the online platform 1700 may include relevant parties such as, but not limited to, end-users, administrators, service providers, service consumers, and so on. Accordingly, in some instances, electronic devices operated by the one or more relevant parties may be in communication with the platform.

A user 1712, such as the one or more relevant parties, may access online platform 1700 through a web based software application or browser. The web based software application may be embodied as, for example, but not be limited to, a website, a web application, a desktop application, and a mobile application compatible with a computing device 1800.

Figure 18:
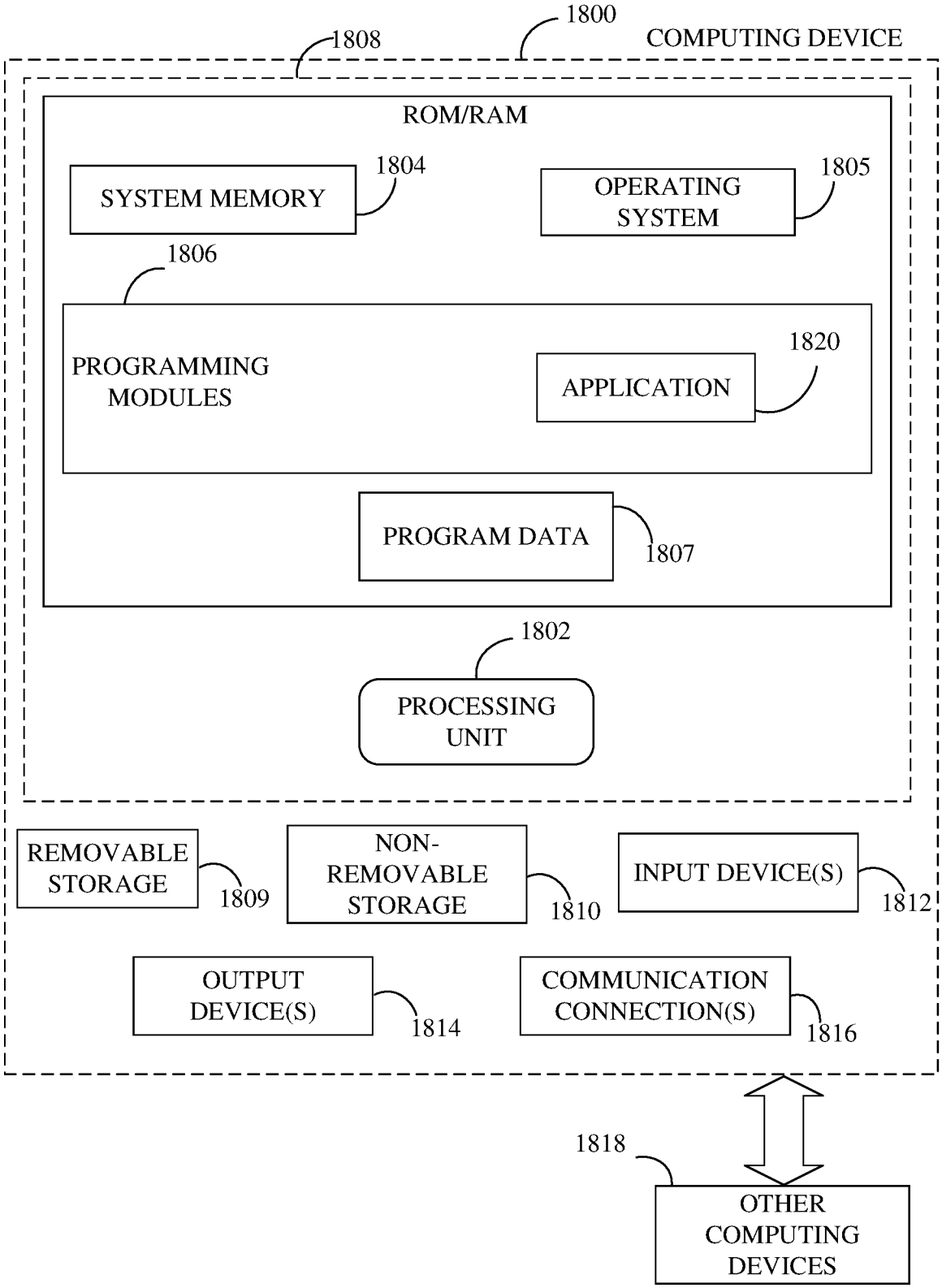
FIG. 18 is a block diagram of a computing device for implementing the methods disclosed herein, in accordance with some embodiments.

With reference to FIG. 18, a system consistent with an embodiment of the disclosure may include a computing device or cloud service, such as computing device 1800. In a basic configuration, computing device 1800 may include at least one processing unit 1802 and a system memory 1804. Depending on the configuration and type of computing device, system memory 1804 may comprise, but is not limited to, volatile (e.g. random-access memory (RAM)), non-volatile (e.g. read-only memory (ROM)), flash memory, or any combination. System memory 1804 may include operating system 1805, one or more programming modules 1806, and may include a program data 1807. Operating system 1805, for example, may be suitable for controlling computing device 1800's operation. In one embodiment, programming modules 1806 may include image-processing module, machine learning module. Furthermore, embodiments of the disclosure may be practiced in conjunction with a graphics library, other operating systems, or any other application program and is not limited to any particular application or system. This basic configuration is illustrated in FIG. 18 by those components within a dashed line 1808.

Computing device 1800 may have additional features or functionality. For example, computing device 1800 may also include additional data storage devices (removable and/or non-removable) such as, for example, magnetic disks, optical disks, or tape. Such additional storage is illustrated in FIG. 18 by a removable storage 1809 and a non-removable storage 1810. Computer storage media may include volatile and non-volatile, removable and non-removable media implemented in any method or technology for storage of information, such as computer-readable instructions, data structures, program modules, or other data. System memory 1804, removable storage 1809, and non-removable storage 1810 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1800. Any such computer storage media may be part of device 1800. Computing device 1800 may also have input device(s) 1812 such as a keyboard, a mouse, a pen, a sound input device, a touch input device, a location sensor, a camera, a biometric sensor, etc. Output device(s) 1814 such as a display, speakers, a printer, etc. may also be included. The aforementioned devices are examples and others may be used.

Computing device 1800 may also contain a communication connection 1816 that may allow device 1800 to communicate with other computing devices 1818, such as over a network in a distributed computing environment, for example, an intranet or the Internet. Communication connection 1816 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 1804, including operating system 1805. While executing on processing unit 1802, programming modules 1806 (e.g., application 1820 such as a media player) may perform processes including, for example, one or more stages of methods, algorithms, systems, applications, servers, databases as described above. The aforementioned process is an example, and processing unit 1802 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the present disclosure has been explained in relation to its preferred embodiment, it is to be understood that many other possible modifications and variations can be made without departing from the spirit and scope of the disclosure.

What is claimed is:

1. An apparatus for facilitating cleaning of a pool, wherein the apparatus comprises at least one angled nozzle disposed in the pool, wherein the at least one angled nozzle is configured to be attached to at least one return line of a dilution system of the pool, wherein each of the at least one return line carries a first amount of water of the pool from the dilution system to each of the at least one angled nozzle for dispensing the first amount of water into the pool, wherein each of the at least one angled nozzle comprises:

an inlet nozzle portion configured to be attached to an outlet portion of each of the at least one return line to align an inlet opening of the inlet nozzle portion with an opening of the outlet portion for fluidly coupling each of the at least one angled nozzle to each of the at least one return line;

an outlet nozzle portion comprising an outlet opening;

a curved nozzle portion extending between the inlet nozzle portion and the outlet nozzle portion, wherein the inlet nozzle portion, the outlet nozzle portion, and the curved nozzle portion define an internal channel for fluidly coupling the inlet opening with the outlet opening, wherein a central axis of the outlet nozzle portion is offset at an angle relative to a central axis of the inlet nozzle portion based on the curved nozzle portion, wherein the angle is at least one acute angle, wherein the first amount of water flows out of the outlet opening in the pool with at least one flow characteristic based on the angle, wherein the flowing of the first amount of water in the pool imparts a circular motion to a second amount of water present in the pool with at least one motion characteristic based on the at least one flow characteristic of the first amount of water, wherein the imparting of the circular motion to the second amount of water present in the pool with the at least one motion characteristic facilitates the cleaning of the second amount of water present in the pool, wherein the outlet nozzle portion comprises at least one shutter disposed around the outlet opening, wherein the at least one shutter is configured to be retractably extended between a plurality of shutter positions, wherein the plurality of shutter positions corresponds to a plurality of opening areas of the outlet opening, wherein the at least one flow characteristic of the first amount of water flowing out of the outlet opening in the pool is further based on each of the plurality of opening areas;

at least one sensor configured for generating at least one sensor data based on detecting an amount of water present in the pool;

a processing device communicatively coupled with the at least one sensor, wherein the processing device is configured for:

analyzing the at least one sensor data:

determining an opening area from the plurality of opening areas for the outlet opening based on the analyzing of the at least one sensor data, wherein the opening area corresponds to a shutter position of the plurality of shutter positions; and generating at least one first command for extending the at least one shutter to the shutter position based on the determining of the opening area; and at least one actuator disposed on the at least one angled nozzle, wherein the at least one actuator is communicatively coupled with the processing device, wherein the at least one actuator is operatively coupled with the at least one shutter, wherein the at least one actuator is configured for extending the at least one shutter to the shutter position based on the at least one first command.

2. The apparatus of claim 1, wherein the outlet nozzle portion is fixedly coupled with the curved nozzle portion, wherein the curved nozzle portion is rotatably coupled with the inlet nozzle portion using a ball joint mechanism, wherein the ball joint mechanism allows the curved nozzle portion to be rotated about the central axis of the inlet nozzle portion between a plurality of first positions, wherein the at least one flow characteristic of the first amount of water flowing out of the outlet opening in the pool is further based on each of the plurality of first positions.

3. The apparatus of claim 2, wherein the ball joint mechanism further allows the curved nozzle portion to be rotated about a first axis perpendicular to the central axis of the inlet nozzle portion between a plurality of second positions, wherein the angle corresponds to each of the plurality of second positions.

4. The apparatus of claim 3, wherein the ball joint mechanism further allows the curved nozzle portion to be rotated about a second axis perpendicular to the first axis and the central axis of the inlet nozzle portion between a plurality of third positions, wherein the at least one flow characteristic of the first amount of water flowing out of the outlet opening in the pool is further based on each of the plurality of third positions.

5. The apparatus of claim 4, wherein the processing device is further configured for:

determining at least one of at least one first position from the plurality of first positions, at least one second position from the plurality of second positions, and at least one third position from the plurality of third positions for the at least one angled nozzle based on the analyzing of the at least one sensor data; and generating at least one command for rotating the at least one angled nozzle to at least one of the at least one first position, the at least one second position, and the at least one third position based on the determining, wherein the at least one actuator is further operatively coupled with the ball joint mechanism, wherein the at least one actuator is configured for rotating the curved nozzle portion of each of the at least one angled nozzle to at least one of the at least one first position, the at least one second position, and the at least one third position based on the at least one command.

6. The apparatus of claim 5 further comprising at least one first sensor communicatively coupled with the processing device, wherein the at least one first sensor is configured for generating at least one first sensor data based on detecting a vertical distance from the at least one angled nozzle to a water level of the second amount of water present in the pool, wherein the processing device is configured for analyzing the at least one first sensor data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one first sensor data.

7. The apparatus of claim 5 further comprising at least one second sensor communicatively coupled with the processing device, wherein the at least one second sensor is configured for generating at least one second sensor data based on detecting a position of at least one contaminant in relation to each of the at least one angled nozzle, wherein the processing device is further configured for analyzing the at least one second sensor data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one second sensor data.

8. The apparatus of claim 5 further comprising at least one third sensor communicatively coupled with the processing device, wherein the at least one third sensor is configured for generating at least one third sensor data based on detecting a vertical distance from the at least one angled nozzle to a floor of the pool, wherein the processing device is configured for analyzing the at least one third sensor data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one third sensor data.

9. The apparatus of claim 5 further comprising at least one fluid sensor communicatively coupled with the processing device, wherein the at least one fluid sensor is configured for generating at least one fluid data based on detecting at least one fluid characteristic of the first amount of water, wherein the processing device is configured for analyzing the at least one fluid data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one fluid data.

10. The apparatus of claim 1, wherein the inlet nozzle portion comprises at least one thread disposed on an exterior surface of the inlet nozzle portion, wherein the inlet nozzle portion threadedly engages with the outlet portion of each of the at least one return line for attaching each of the at least one angled nozzle to each of the at least one return line.

11. The apparatus of claim 1, wherein the inlet nozzle portion receives the outlet portion of each of the at least one return line for attaching each of the at least one angled nozzle to each of the at least one return line.

12. An apparatus for facilitating cleaning of a pool, wherein the apparatus comprises at least one angled nozzle disposed in the pool, wherein the at least one angled nozzle is configured to be attached to at least one return line of a dilution system of the pool, wherein each of the at least one return line carries a first amount of water of the pool from the dilution system to each of the at least one angled nozzle for dispensing the first amount of water into the pool, wherein each of the at least one angled nozzle comprises:

an inlet nozzle portion configured to be attached to an outlet portion of each of the at least one return line to align an inlet opening of the inlet nozzle portion with an opening of the outlet portion for fluidly coupling each of the at least one angled nozzle to each of the at least one return line;

an outlet nozzle portion comprising an outlet opening;

a curved nozzle portion extending between the inlet nozzle portion and the outlet nozzle portion, wherein the inlet nozzle portion, the outlet nozzle portion, and the curved nozzle portion define an internal channel for fluidly coupling the inlet opening with the outlet opening, wherein a central axis of the outlet nozzle portion is offset at an angle relative to a central axis of the inlet nozzle portion based on the curved nozzle portion, wherein the angle is at least one acute angle, wherein the first amount of water flows out of the outlet opening in the pool with at least one flow characteristic based on the angle, wherein the flowing of the first amount of water in the pool imparts a circular motion to a second amount of water present in the pool with at least one motion characteristic based on the at least one flow characteristic of the first amount of water, wherein the imparting of the circular motion to the second amount of water present in the pool with the at least one motion characteristic facilitates the cleaning of the second amount of water present in the pool, wherein the outlet nozzle portion is fixedly coupled with the curved nozzle portion, wherein the curved nozzle portion is rotatably coupled with the inlet nozzle portion using a ball joint mechanism, wherein the ball joint mechanism allows the curved nozzle portion to be rotated about the central axis of the inlet nozzle portion between a plurality of first positions, wherein the at least one flow characteristic of the first amount of water flowing out of the outlet opening in the pool is further based on each of the plurality of first positions, wherein the ball joint mechanism further allows the curved nozzle portion to be rotated about a first axis perpendicular to the central axis of the inlet nozzle portion between a plurality of second positions, wherein the angle corresponds to each of the plurality of second positions, wherein the ball joint mechanism further allows the curved nozzle portion to be rotated about a second axis perpendicular to the first axis and the central axis of the inlet nozzle portion between a plurality of third positions, wherein the at least one flow characteristic of the first amount of water flowing out of the outlet opening in the pool is further based on each of the plurality of third positions;

at least one sensor configured for generating at least one sensor data based on detecting an amount of water present in the pool;

a processing device communicatively coupled with the at least one sensor, wherein the processing device is configured for:

analyzing the at least one sensor data;

determining at least one of at least one first position from the plurality of first positions, at least one second position from the plurality of second positions, and at least one third position from the plurality of third positions for the at least one angled nozzle based on the analyzing of the at least one sensor data; and generating at least one command for rotating the at least one angled nozzle to at least one of the at least one first position, the at least one second position, and the at least one third position based on the determining; and at least one actuator disposed on the at least one angled nozzle, wherein the at least one actuator is communicatively coupled with the processing device, wherein the at least one actuator is operatively coupled with the ball joint mechanism, wherein the at least one actuator is configured for rotating the curved nozzle portion of each of the at least one angled nozzle to at least one of the at least one first position, the at least one second position, and the at least one third position based on the at least one command.

13. The apparatus of claim 12 further comprising at least one first sensor communicatively coupled with the processing device, wherein the at least one first sensor is configured for generating at least one first sensor data based on detecting a vertical distance from the at least one angled nozzle to a water level of the second amount of water present in the pool, wherein the processing device is configured for analyzing the at least one first sensor data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one first sensor data.

14. The apparatus of claim 12 further comprising at least one second sensor communicatively coupled with the processing device, wherein the at least one second sensor is configured for generating at least one second sensor data based on detecting a position of at least one contaminant in relation to each of the at least one angled nozzle, wherein the processing device is further configured for analyzing the at least one second sensor data, wherein the determining for at least one of the at least one first position from the plurality of first positions, the at least one second position from the plurality of second positions, and the at least one third position from the plurality of third positions for the curved nozzle portion of each of the at least one angled nozzle is further based on the analyzing of the at least one second sensor data.

15. An apparatus for facilitating cleaning of a pool, wherein the apparatus comprises at least one angled nozzle disposed in the pool, wherein the at least one angled nozzle is configured to be attached to at least one return line of a dilution system of the pool, wherein each of the at least one return line carries a first amount of water of the pool from the dilution system to each of the at least one angled nozzle for dispensing the first amount of water into the pool, wherein each of the at least one angled nozzle comprises:

an inlet nozzle portion configured to be attached to an outlet portion of each of the at least one return line to align an inlet opening of the inlet nozzle portion with an opening of the outlet portion for fluidly coupling each of the at least one angled nozzle to each of the at least one return line;

an outlet nozzle portion comprising an outlet opening;

a curved nozzle portion extending between the inlet nozzle portion and the outlet nozzle portion, wherein the inlet nozzle portion, the outlet nozzle portion, and the curved nozzle portion define an internal channel for fluidly coupling the inlet opening with the outlet opening, wherein a central axis of the outlet nozzle portion is offset at an angle relative to a central axis of the inlet nozzle portion based on the curved nozzle portion, wherein the angle is at least one acute angle, wherein the first amount of water flows out of the outlet opening in the pool with at least one flow characteristic based on the angle, wherein the flowing of the first amount of water in the pool imparts a circular motion to a second amount of water present in the pool with at least one motion characteristic based on the at least one flow characteristic of the first amount of water, wherein the imparting of the circular motion to the second amount of water present in the pool with the at least one motion characteristic facilitates the cleaning of the second amount of water present in the pool, wherein the outlet nozzle portion is fixedly coupled with the curved nozzle portion, wherein the curved nozzle portion is rotatably coupled with the inlet nozzle portion using a ball joint mechanism, wherein the ball joint mechanism allows the curved nozzle portion to be rotated about the central axis of the inlet nozzle portion between a plurality of first positions, wherein the at least one flow characteristic of the first amount of water flowing out of the outlet opening in the pool is further based on each of the plurality of first positions, wherein the ball joint mechanism further allows the curved nozzle portion to be rotated about a first axis perpendicular to the central axis of the inlet nozzle portion between a plurality of second positions, wherein the angle corresponds to each of the plurality of second positions, wherein the ball joint mechanism further allows the curved nozzle portion to be rotated about a second axis perpendicular to the first axis and the central axis of the inlet nozzle portion between a plurality of third positions, wherein the at least one flow characteristic of the first amount of water flowing out of the outlet opening in the pool is further based on each of the plurality of third positions, wherein the outlet nozzle portion comprises at least one shutter disposed around the outlet opening, wherein the at least one shutter is configured to be retractably extended between a plurality of shutter positions, wherein the plurality of shutter positions corresponds to a plurality of opening areas of the outlet opening, wherein the at least one flow characteristic of the first amount of water flowing out of the outlet opening in the pool is further based on each of the plurality of opening areas;

at least one sensor configured for generating at least one sensor data based on detecting an amount of water present in the pool:

a processing device communicatively coupled with the at least one sensor, wherein the processing device is configured for:

analyzing the at least one sensor data;

determining an opening area from the plurality of opening areas for the outlet opening based on the analyzing of the at least one sensor data, wherein the opening area corresponds to a shutter position of the plurality of shutter positions; and generating at least one first command for extending the at least one shutter to the shutter position based on the determining of the opening area; and at least one actuator disposed on the at least one angled nozzle, wherein the at least one actuator is communicatively coupled with the processing device, wherein the at least one actuator is operatively coupled with the at least one shutter, wherein the at least one actuator is configured for extending the at least one shutter to the shutter position based on the at least one first command.

* * * * *